US010422184B1

(12) United States Patent
Feddema et al.

(10) Patent No.: US 10,422,184 B1
(45) Date of Patent: Sep. 24, 2019

(54) DOWNHOLE TOOL FOR VERTICAL AND DIRECTIONAL CONTROL

(71) Applicant: SANVEAN TECHNOLOGIES LLC, Katy, TX (US)

(72) Inventors: Chad Feddema, Conroe, TX (US); Stephen Jones, Cypress, TX (US); Junichi Sugiura, Bristol (GB)

(73) Assignee: SANVEAN TECHNOLOGIES LLC, Katy, TX (US)

( * ) Notice: Subject to any disclaimer, the term of this patent is extended or adjusted under 35 U.S.C. 154(b) by 0 days.

(21) Appl. No.: 16/163,358

(22) Filed: Oct. 17, 2018

(51) Int. Cl.
*E21B 7/06* (2006.01)

(52) U.S. Cl.
CPC ..... *E21B 7/06* (2013.01)

(58) Field of Classification Search
CPC ..... E21B 34/10; E21B 23/04; E21B 17/1014; E21B 7/04; E21B 7/068; E21B 7/062; E21B 7/06
See application file for complete search history.

(56) References Cited

U.S. PATENT DOCUMENTS

2005/0109542 A1* 5/2005 Downton ..... E21B 7/062 175/73
2009/0090554 A1* 4/2009 Sugiura ..... E21B 7/062 175/24
2009/0173541 A1* 7/2009 Tulloch ..... E21B 7/04 175/45
2010/0126770 A1* 5/2010 Sugiura ..... E21B 7/062 175/38
2011/0017473 A1* 1/2011 Clarkson ..... E21B 7/062 166/380
2012/0160563 A1* 6/2012 Clark ..... E21B 7/06 175/61
2012/0160564 A1* 6/2012 Downton ..... E21B 7/062 175/61
2012/0160565 A1* 6/2012 Downton ..... E21B 7/062 175/61
2014/0014413 A1* 1/2014 Niina ..... E21B 7/062 175/61
2016/0060960 A1* 3/2016 Parkin ..... E21B 17/10 175/24
2016/0069139 A1* 3/2016 Sugiura ..... E21B 7/06 175/61
2017/0198525 A1* 7/2017 Feddema ..... E21B 7/06
2018/0066513 A1* 3/2018 Sugiura ..... E21B 7/04
2018/0094490 A1* 4/2018 Lines ..... E21B 7/067
2018/0128060 A1* 5/2018 Haugvaldstad ..... E21B 17/1014
2018/0252088 A1* 9/2018 Tilley ..... E21B 7/06
2018/0258702 A1* 9/2018 Marson ..... E21B 7/067
2018/0340374 A1* 11/2018 Moore ..... E21B 7/067

* cited by examiner

*Primary Examiner* — Jennifer H Gay
(74) *Attorney, Agent, or Firm* — Adolph Locklar

(57) ABSTRACT

A downhole steering tool includes one or more steering blades selectively extendable from a housing. Each steering blade may be extended by fluid pressure within a steering cylinder. Each steering cylinder may be coupled to the interior of a mandrel positioned within the housing through an adjustable orifice. The adjustable orifice may be moved between an open and a partially open position. The adjustable orifice may be controlled by a ring valve.

28 Claims, 21 Drawing Sheets

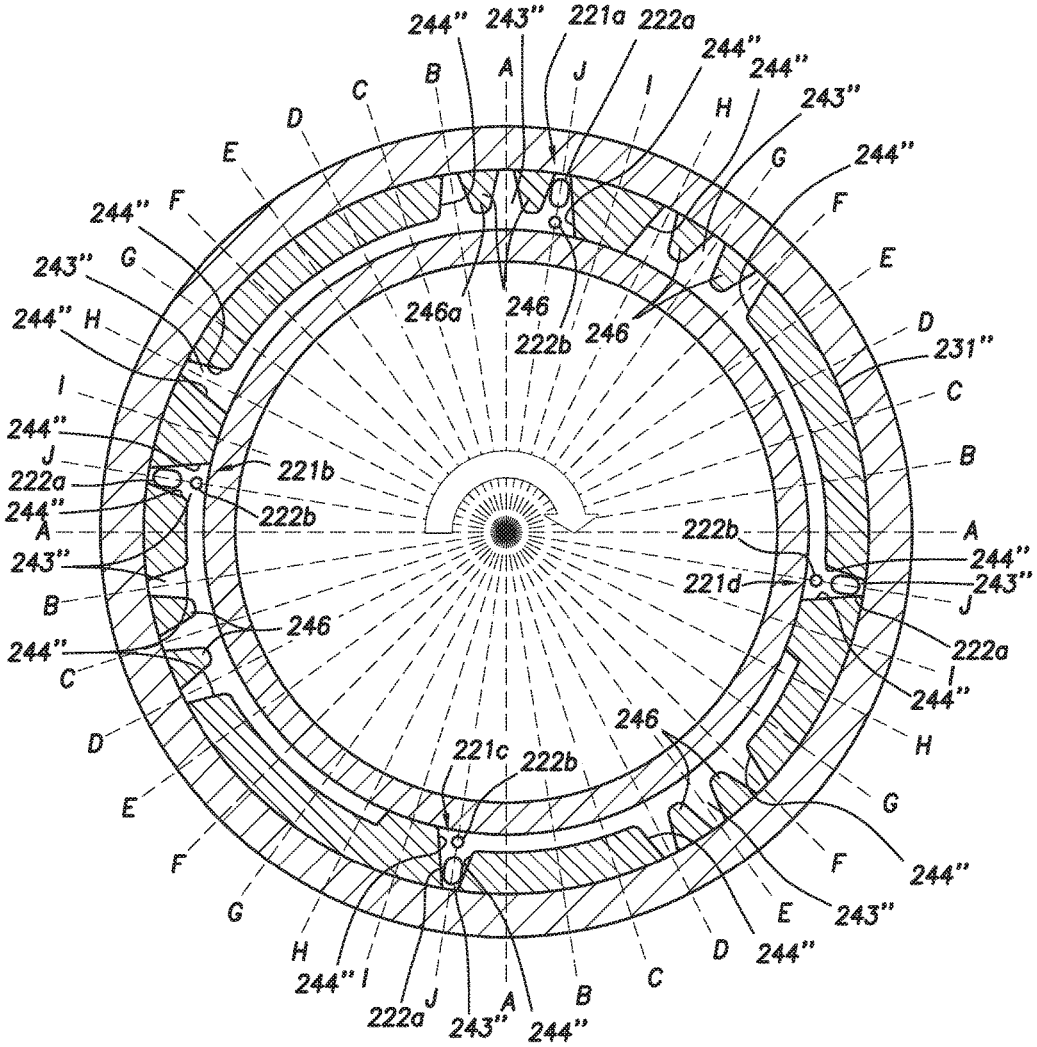
244"
243"
221a
222a
244"
244"
243"
244"
A
B
C
D
E
F
G
H
I
J
246a
246
222b
246
231"
221b
222b
221d
221c
222b
246
244"
243"
222a
244"
243"
244"
243"
244"
243"

DOWNHOLE TOOL FOR VERTICAL AND DIRECTIONAL CONTROL

TECHNICAL FIELD/FIELD OF THE DISCLOSURE

The present disclosure relates generally to downhole drilling tools, and specifically to anti-rotation and steering devices for downhole tools.

BACKGROUND OF THE DISCLOSURE

When drilling a wellbore, maintaining a vertical drilling direction may be desired. However, slight deflections of the bottom-hole assembly (BHA) drill string may cause the wellbore to deviate from the vertical axis and thus the wellbore may not propagate as planned. Vertical control devices may be utilized to correct deviation from vertical. Likewise, steerable systems may be utilized to control the direction of propagation of the wellbore. Typically, these devices may include a rotating section, including the drill bit and any associated shafts, and a non-rotating section which remains substantially non-rotating relative to the surrounding formation.

Steerable drilling systems are often classified as either "point-the-bit" or "push-the-bit" systems. In point-the-bit systems, the rotational axis of the drill bit is deviated from the longitudinal axis of the drill string generally in the direction of the wellbore. The wellbore may be propagated in accordance with a three-point geometry defined by upper and lower points of contact between the drill string and the wellbore, defined as touch points, and the drill bit. The angle of deviation of the drill bit axis, coupled with the distance between the drill bit and the lower touch point, results in a non-collinear condition that generates a curved wellbore as the drill bit progresses through the formation.

In push-the-bit systems, a non-collinear condition may be achieved by causing one or both of upper and lower stabilizers, for example via blades or pistons, to apply an eccentric force or displacement to the BHA to move the drill bit in the desired path. Steering may be achieved by creating a non-collinear condition between the drill bit and at least two other touch points, such as upper and lower stabilizers, for example.

SUMMARY

The present disclosure provides for a downhole steering tool. The downhole steering tool may include a housing coupled to and positioned about a tubular mandrel. The housing may be able to rotate about the mandrel. The housing may have a steering cylinder formed therein. The downhole steering tool may include a steering blade coupled to the housing. The steering blade may be at least partially positioned within the steering cylinder. The steering blade may be extendable by an extension force to contact a wellbore. The extension force may be caused by a differential pressure between a steering cylinder pressure and a pressure in the wellbore surrounding the downhole tool. The differential pressure may be caused by fluid pressure of a fluid within the steering cylinder. The steering cylinder may be fluidly coupled to a steering port. The downhole steering tool may include a ring valve. The ring valve may include a manifold being generally tubular and including an upper manifold surface. The manifold may include at least one manifold orifice set, each manifold orifice set including two or more manifold orifices extending between the upper manifold surface and the steering port. The manifold orifice set may define an adjustable orifice fluidly coupled between an interior of the mandrel and the steering cylinder. The adjustable orifice may be adjustable between an open position and at least one of a partially open position and a closed position. The ring valve may include a valve ring being annular. The valve ring may have a lower ring surface positioned in abutment with the upper manifold surface. The valve ring may have a radial slot formed in the lower ring surface. The valve ring may be rotatable relative to the manifold.

The present disclosure also provides for a method. The method may include providing a downhole steering tool. The downhole steering tool may include a housing coupled to and positioned about a tubular mandrel. The housing may be able to rotate about the mandrel. The downhole steering tool may include a steering cylinder formed in the housing. The steering cylinder may be fluidly coupled to a steering port. The downhole steering tool may include a steering blade coupled to the housing. The steering blade may be at least partially positioned within the steering cylinder. The steering blade may be extendable by an extension force to contact a wellbore. The steering cylinder may be positioned to exert an extension force on the steering blade. The downhole steering tool may include a ring valve. The ring valve may include a manifold being generally tubular and including an upper manifold surface. The manifold including at least one manifold orifice set, each manifold orifice set including two or more manifold orifices extending between the upper manifold surface and the steering port. The manifold orifice set may define an adjustable orifice fluidly coupled between an interior of the mandrel and the steering cylinder. The adjustable orifice may be adjustable between an open position and at least one of a partially open position and a closed position. The ring valve may include a valve ring, the valve ring being annular. The valve ring may have a lower ring surface positioned in abutment with the upper manifold surface. The valve ring may have a radial slot formed in the lower ring surface. The valve ring may be rotatable relative to the manifold. The method may include positioning the downhole steering tool in a wellbore and supplying the fluid to the interior of the mandrel, the fluid at a pressure higher than the pressure in the surrounding wellbore. The method may include partially opening the adjustable orifice. The method may include flowing the fluid into the steering cylinder through the adjustable orifice such that the fluid within the steering cylinder generates a differential pressure between a steering cylinder pressure and a pressure in the wellbore surrounding the downhole steering tool such that the differential pressure generates a first extension force on the first steering blade. The method may include extending the first steering blade with the first extension force. The method may include opening the adjustable orifice and extending the first steering blade with a second extension force, the second extension force being higher than the first extension force.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

FIG. 13 depicts a semitransparent view of a ring valve consistent with at least one embodiment of the present disclosure.

DETAILED DESCRIPTION

Figure 1:
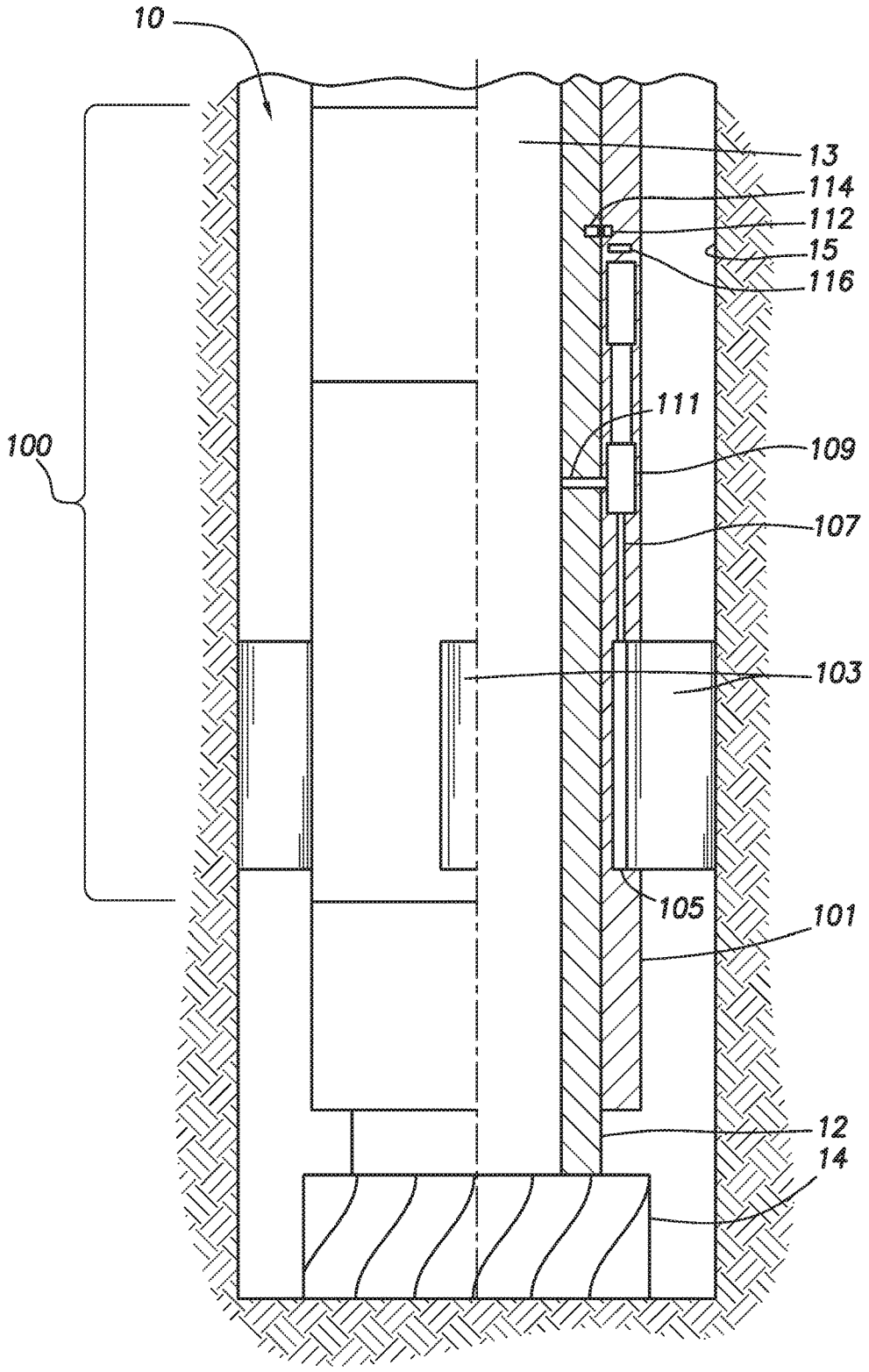
FIG. 1 depicts a schematic view of a downhole steering tool in partial cross section consistent with at least one embodiment of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

As depicted in FIG. 1, downhole steering tool 100 may be included as part of drill string 10. In some embodiments, downhole steering tool 100 may be included as part of a bottomhole assembly of drill string 10. In some embodiments, downhole steering tool 100 may be positioned about mandrel 12 of drill string 10. Mandrel 12 may be coupled to drill bit 14 and adapted to provide rotational force thereto to form wellbore 15. In some embodiments, mandrel 12 may be coupled to drill string 10 such that rotation of drill string 10 from the surface by, for example and without limitation, a rotary table or top drive, causes rotation of mandrel 12. In some embodiments, mandrel 12 may be coupled to a downhole motor such as a mud motor or downhole turbine (not shown) to provide rotation. Downhole steering tool 100 may include housing 101. In some embodiments, housing 101 may be tubular or generally tubular. Housing 101 may be positioned about mandrel 12 and may be rotatably coupled thereto such that mandrel 12 may rotate independently of housing 101. In some embodiments, for example and without limitation, one or more bearings may be positioned between housing 101 and mandrel 12. Although shown as a single piece, one having ordinary skill in the art with the benefit of this disclosure will understand that housing 101 may be formed from one or more pieces.

In some embodiments, housing 101 may rotate at a speed that is less than the rotation rate of the drill bit and mandrel 12. In some embodiments, housing 101 may rotate at a speed that is less than the rotation speed of mandrel 12. For example and without limitation, housing 101 may rotate at a speed at least 50 RPM slower than mandrel 12. For example and without limitation, in an instance where mandrel 12 rotates at 51 RPM, housing 101 may rotate at 1 RPM or less. In some embodiments, housing 101 may be substantially non-rotating, and may rotate at a speed that is less than a percentage of the rotation speed of mandrel 12. For example and without limitation, housing 101 may rotate at a speed lower than 50% of the speed of mandrel 12. In some embodiments, housing 101, by not rotating substantially, may maintain a toolface orientation independent of rotation of drill string 10.

In some embodiments, downhole steering tool 100 may include one or more steering blades 103. Steering blades 103 may be positioned about a periphery of housing 101. Steering blades 103 may be extendible to contact wellbore 15. In some embodiments, steering blades 103 may be at least partially positioned within steering cylinders 105 and may be sealed thereto. Steering cylinders 105 may be formed in housing 101. Steering cylinders 105 may, in some embodiments, be cavities formed in housing 101 into which steering blades 103 are at least partially positioned such that fluid may flow into steering cylinders 105 and abut steering blade 103. Fluid pressure within each steering cylinder 105, defining a steering cylinder pressure, may increase above fluid pressure in the surrounding wellbore 15, defining a wellbore pressure, thereby causing a differential pressure across the steering blade 103 positioned therein. The differential pressure may cause an extension force on steering blade 103. The extension force on steering blade 103 may urge steering blade 103 into an extended position. When positioned within wellbore 15, the extension force may cause steering blade 103 to contact wellbore 15. In some embodiments, steering blade 103 may, for example and without limitation, at least partially prevent or retard rotation of housing 101 to, for example and without limitation, less than 20 revolutions per hour.

In some embodiments, fluid may be supplied to each steering cylinder 105 through a steering port 107 formed as fluid conduits in housing 101. In some embodiments, the fluid may be drilling mud. The fluid in each steering port 107 may be controlled by one or more adjustable orifices 109. Fluids may include, but are not limited to, drilling mud, such as oil-based drilling mud or water-based drilling mud, air, mist, foam, water, oil, including gear oil, hydraulic fluid or other fluids within wellbore 15. Adjustable orifices 109 may control fluid flow between an interior of mandrel 12 and steering ports 107. In some embodiments, each steering cylinder 105 is controlled by an adjustable orifice 109. In some embodiments, one or more steering blades 103 may be aligned about downhole steering tool 100 and may be controlled by the same adjustable orifice 109. As used herein, "adjustable orifice" includes any valve or mechanism having an adjustable flow rate or restriction to flow.

Fluid may be supplied to each adjustable orifice 109 from an interior 13 of mandrel 12. Adjustable orifice 109 may be fluidly coupled to the interior 13 of mandrel 12. In some embodiments, for example and without limitation, one or more apertures 111 may be formed in mandrel 12 which may be coupled to each adjustable orifice 109 allowing fluid to flow to each adjustable orifice 109 as mandrel 12 rotates relative to housing 101. In some embodiments, as further discussed herein below, a diverter may be utilized.

Figure 2A:
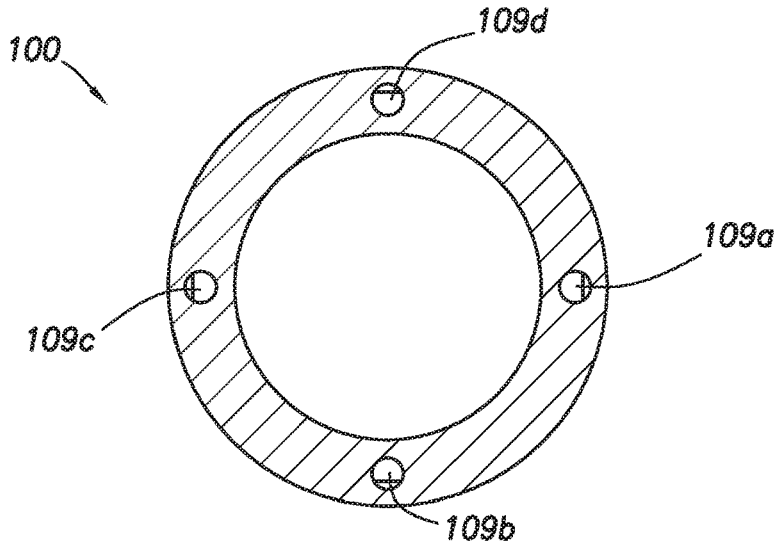
FIGS. 2A, 2B depict schematic cross sections of the downhole steering tool of FIG. 1 in a centralizing position.
Figure 2B:
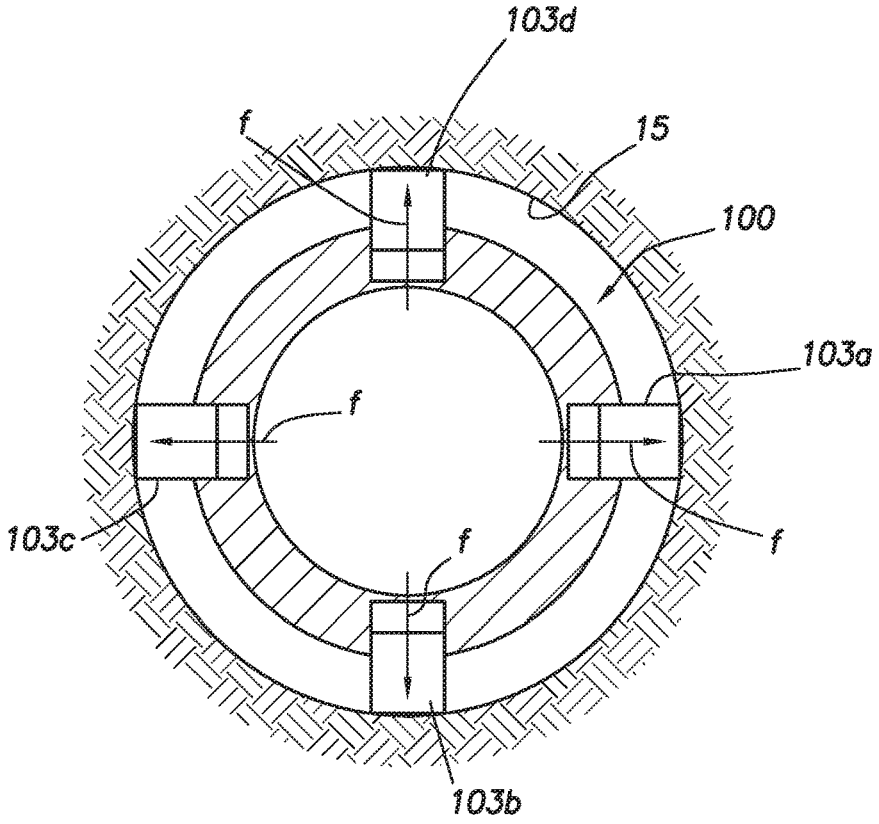

In some embodiments, adjustable orifices 109 may be reconfigurable between an open position and a partially open position. In some embodiments, adjustable orifices 109 may further have a closed position. In the partially open position, adjustable orifices 109 may remain partially open such that an amount of fluid may pass into the corresponding steering cylinder 105. During certain operations, for instance to centralize downhole steering tool 100 within wellbore 15, as depicted schematically and without limitation as to structure in FIG. 2A, each adjustable orifice 109*a-d* may remain in the partially open position, such that only a portion of the amount of fluid may pass therethrough compared to when an adjustable orifice 109 is fully open. In some embodiments, the partially open position may allow between 0% and 50% of the flow of the opened position, between 10% and 40% of the flow of the opened position, or between 25% and 35% of the opened position. Each steering blade 103*a-d* may thus receive a substantially equal differential pressure thereacross and may be extended to contact wellbore 15 with approximately equal extension force, shown graphically as arrows depicting first extension force f. Steering blades 103*a-d* may thus centralize downhole steering tool 100 within wellbore 15. In some embodiments, steering blades 103*a-d* may include one or more anti-rotation features (not shown) on the end thereof such that when in contact with wellbore 15, the force exerted by each steering blade 103*a-d* prevents or retards rotation of downhole steering tool 100 relative to wellbore 15.

Figure 3A:
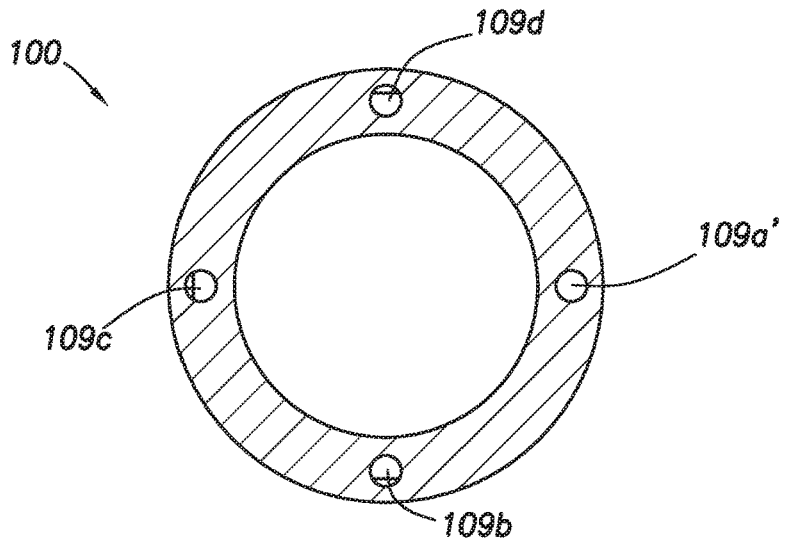
FIGS. 3A, 3B depict schematic cross sections of the downhole steering tool of FIG. 1 in a steering position.
Figure 3B:
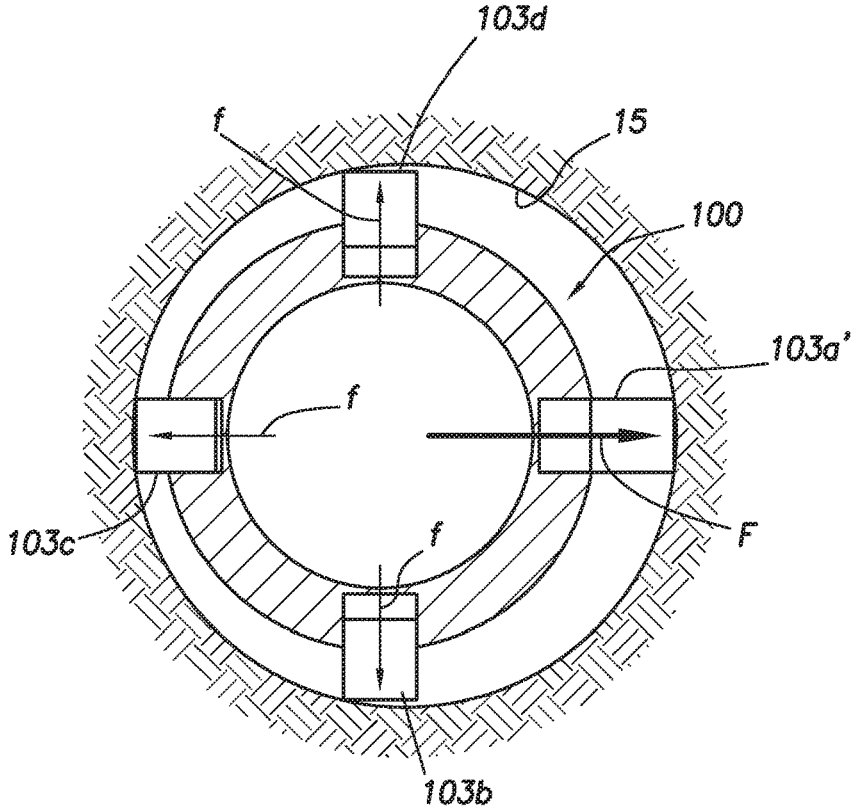

When a steering input is desired, one or more adjustable orifices (depicted as adjustable orifice 109*a*' in FIG. 3A), may be fully opened. The adjustable orifices 109*b-d* not in the open position may remain in the partially open position. With adjustable orifice 109*a*' in the open position, a larger amount of fluid may flow to the corresponding steering blade (103*a*' in FIG. 3B), causing the differential pressure thereacross to be higher than to steering blades 103 not corresponding to a fully open adjustable orifice 109, and thus exerting a larger extension force, depicted as second extension force F thereupon. The opposing steering blade (here 103*c*) (or steering blades depending on configuration) receives a smaller first extension force f, and its extension may be at least partially overcome by the extension of steering blade 103*a*', causing downhole steering tool 100 to be pushed away from wellbore 15 in the direction of steering blade 103*a*'. This second extension force F may thus cause a change in the direction in which downhole steering tool 100 is pushed relative to wellbore 15, referred to herein as a force-vector direction, which may alter the direction in which wellbore 15 is drilled.

In some embodiments, when drilling a straight or nearly straight wellbore 15, all adjustable orifices 109*a-d* may be opened, applying substantially equal pressure to all steering blades 103, causing equal force exerted by all steering blades 103 against wellbore 15. Alternatively, a gripping force may be exerted by all steering blades 103 against wellbore 15 when all adjustable orifices 109*a-d* are partially open.

Figure 4:
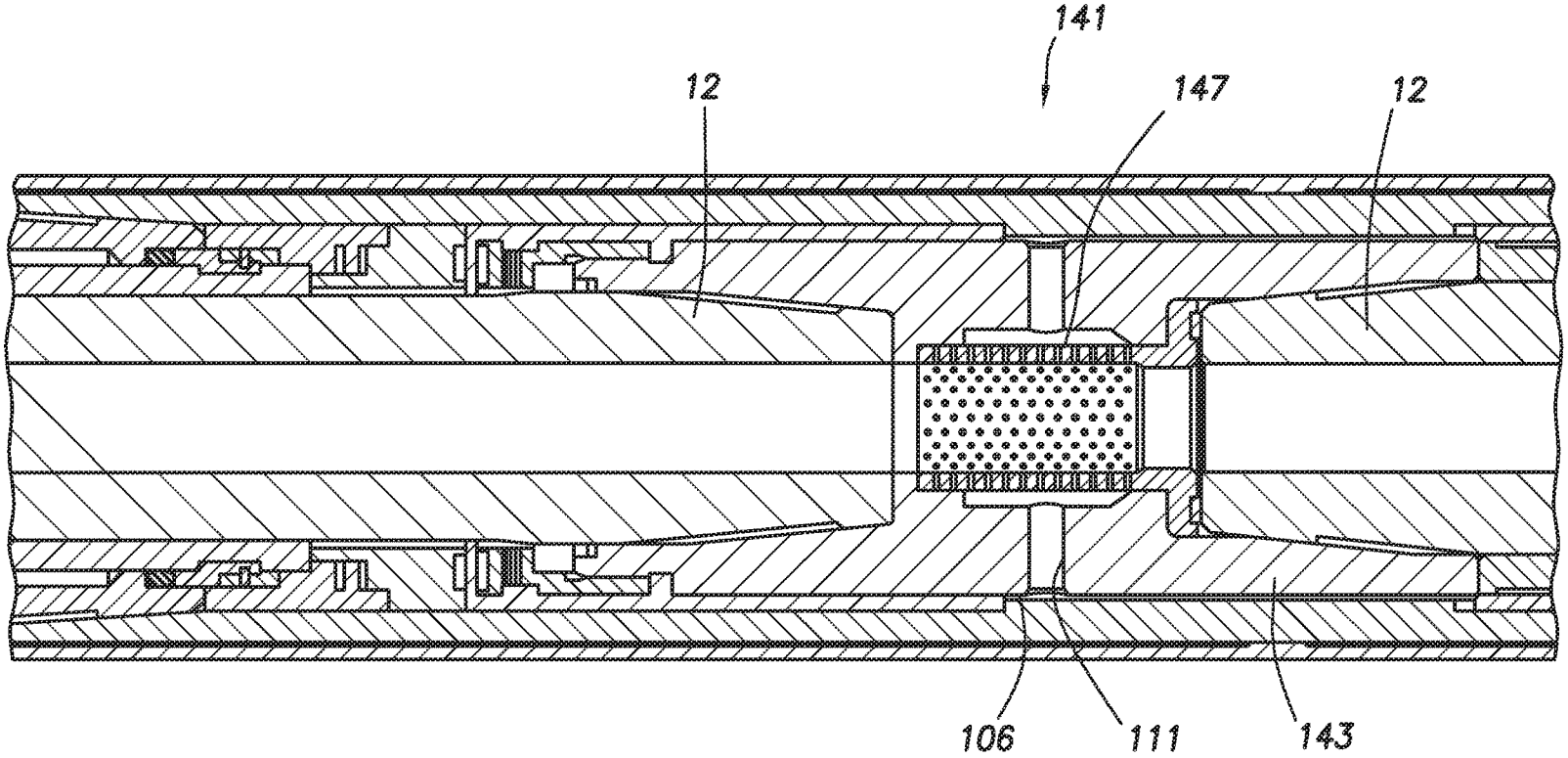
FIG. 4 depicts a cross section view of a diverter of a downhole steering tool consistent with at least one embodiment of the present disclosure.

In some embodiments, as depicted in FIG. 4, fluid may be supplied from the interior of mandrel 12 (here depicted as having two subcomponents coupled to either side of diverter assembly 141) through diverter assembly 141. The fluid within mandrel 12 may include, without limitation, drilling mud, such as oil-based drilling mud or water-based drilling mud; air; mist; foam; water; oil, including gear oil; hydraulic fluid; or a combination thereof. The fluid within mandrel 12 may be supplied by one or more pumps (not shown) at the surface through mandrel 12 to, for example and without limitation, operate one or more downhole tools and clear cuttings from wellbore 15 during a drilling operation. Fluid within mandrel 12 may be at a higher pressure than fluid within wellbore 15. Diverter assembly 141 may include diverter body 143 coupled to and rotatable with mandrel 12. In some embodiments, diverter assembly 141 may be formed integrally with mandrel 12. In some embodiments, diverter assembly 141 may contain drilling fluid filter 147. Diverter body 143 may include one or more apertures 111 coupling the interior of mandrel 12 to one or more fluid supply ports 106 formed within housing 101. Fluid supply ports 106 may supply fluid to adjustable orifices as described herein below. In some embodiments, approximately 4-5% of the flow going through the interior of mandrel 12 may be diverted through diverter assembly 141. In some embodiments, a portion of the diverted fluid may pass into one or more bearings (not shown) and may exit to the annular space about downhole steering tool 100.

Figure 5A:
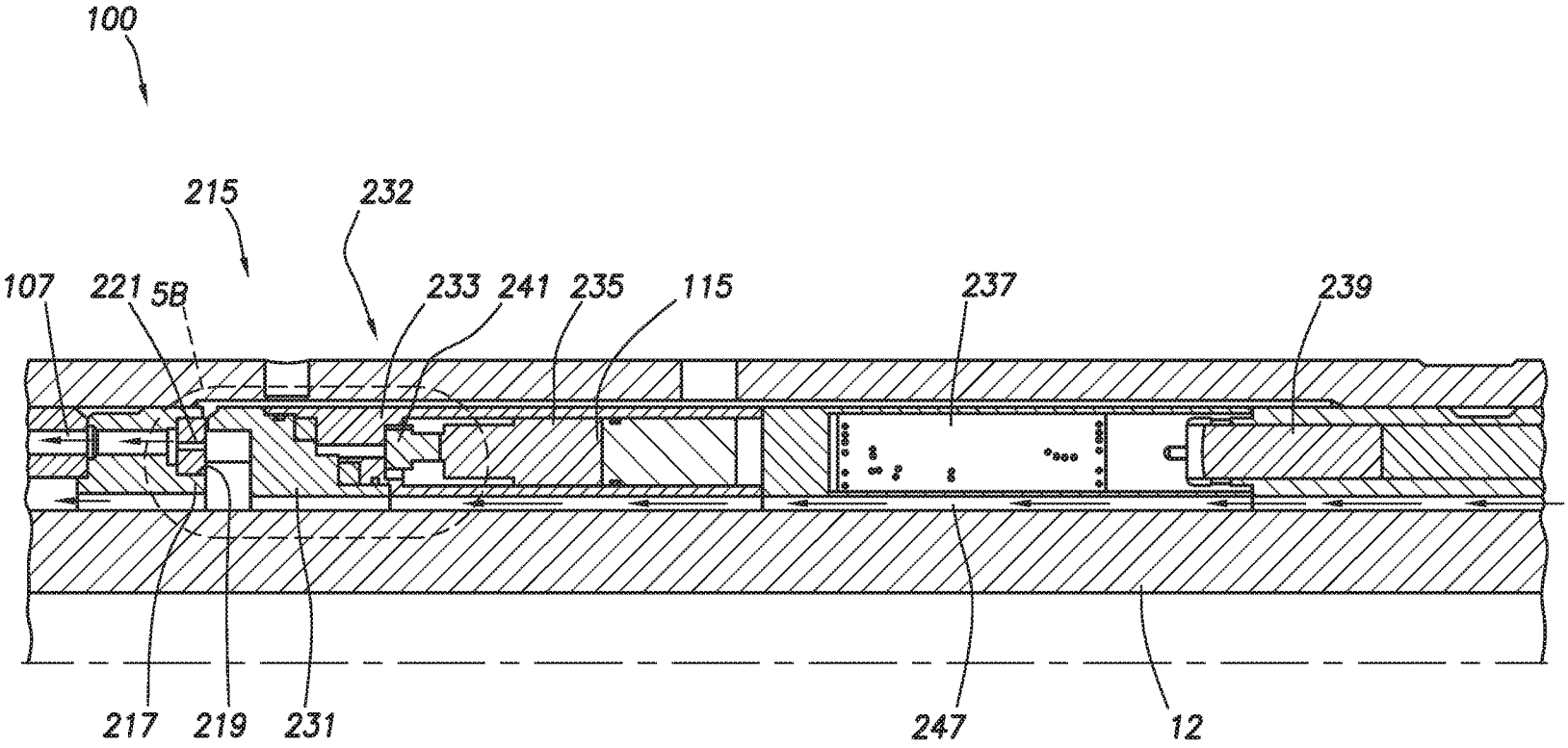
FIG. 5A depicts a partial cross section view of a downhole steering tool consistent with at least one embodiment of the present disclosure.
Figure 5B:
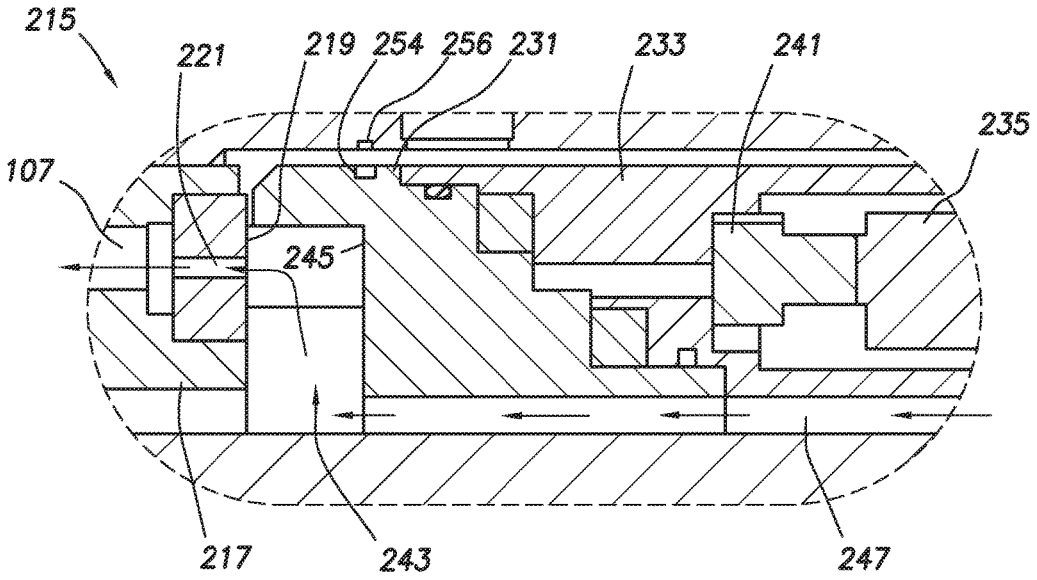
FIG. 5B depicts a detail view of the downhole steering tool of FIG. 5A.

In some embodiments, a controller, discussed herein below as controller 237 shown in FIG. 5A, may control the actuation of adjustable orifices 109.

In some embodiments, controller 237 may include one or more microcontrollers, microprocessors, FPGAs (field programmable gate arrays), a combination of analog devices, such analog integrated circuits (ICs), or any other devices known in the art. In some embodiments, downhole steering tool 100 may include differential rotation sensor 112, which may be operable to measure a difference in rotation rates between mandrel 12 and housing 101, and housing rotation measurement device or sensor 116, which may be operable to measure a rotation rate of housing 101. For example, in some embodiments, differential rotation sensor 112 may include one or more infrared sensors, ultrasonic sensors, Hall-effect sensors, fluxgate magnetometers, magneto-resistive magnetic-field sensors, micro-electro-mechanical system (MEMS) magnetometers, and/or pick-up coils. Differential rotation sensor 112 may interact with one or more markers 114, such as infrared reflection mirrors, ultrasonic reflectors, magnetic markers, permanent magnets, electro magnets, coupled to mandrel 12 which may be, for example and without limitation, one or more magnets or electromagnets to interact with a magnetic differential rotation sensor 112. Housing rotation measurement device or sensor 116 may include one or more accelerometers, magnetometers, and/or gyroscopic sensors, including micro-electro-mechanical system (MEMS) gyros, MEMS accelerometers and/or others operable to measure cross-axial acceleration, magnetic-field components, or a combination thereof. Gyroscopic sensors and/or MEMS gyros may be used to measure the rotation speed of housing 101 and irregular rotation speed of housing 101, such as torsional oscillation and stick-slip. The accelerometers and magnetometers in housing 101 may be used to calculate the toolface of downhole steering tool 100. The toolface of downhole steering tool 100 may, in some embodiments, be referenced to a particular steering blade 103. In some embodiments, the toolface of downhole steering tool 100 may be defined relative to a gravity field, known as a gravity toolface; defined relative to a magnetic field, known as a magnetic toolface; or a combination thereof. Differential rotation sensors 112 and housing rotation measurement device or sensors 116 may be disposed anywhere in the housing 101. Markers 114 may be disposed to the corresponding position on mandrel 12, substantially near differential rotation sensors 112.

Figure 8:
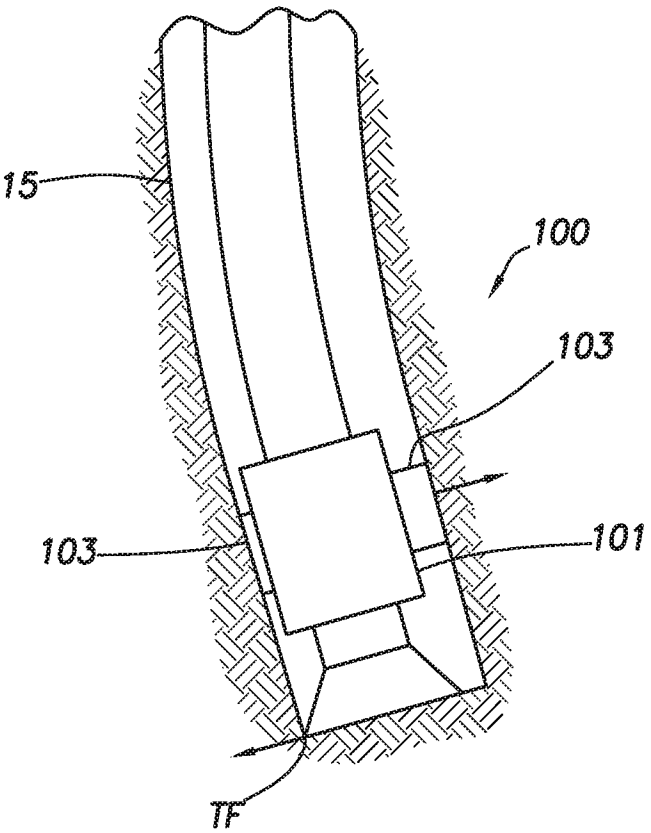
FIG. 8 depicts a cross section of a downhole steering tool consistent with at least one embodiment of the present disclosure.

When drilling a vertical wellbore 15, as depicted in FIG. 8, gravity toolface may be used. To maintain verticality, gravity toolface (GTF) may be set to the low side of wellbore 15, corresponding to a 180° gravity toolface, and at least one steering blade 103 may apply an eccentric force to the side of wellbore 15 opposite the target toolface (TF). In some embodiments, the steering blade 103 may apply an eccentric force to the side of wellbore 15 substantially opposite the target TF, such as, for example and without limitation, within 15° of 180° from the target TF.

In some embodiments, in order to drill wellbore 15 vertically, the target gravity tool face (GTF) of downhole steering tool 100 may be set to the low side of the borehole (GTF=180°). In some embodiments, the equation for the GTF may be given by:

$$GTF = \arctan\left(\frac{G_y}{G_x}\right).$$

The accuracy of GTF near vertical may depend on the accuracy of the transverse acceleration measurements (Gx and Gy).

Figure 9:
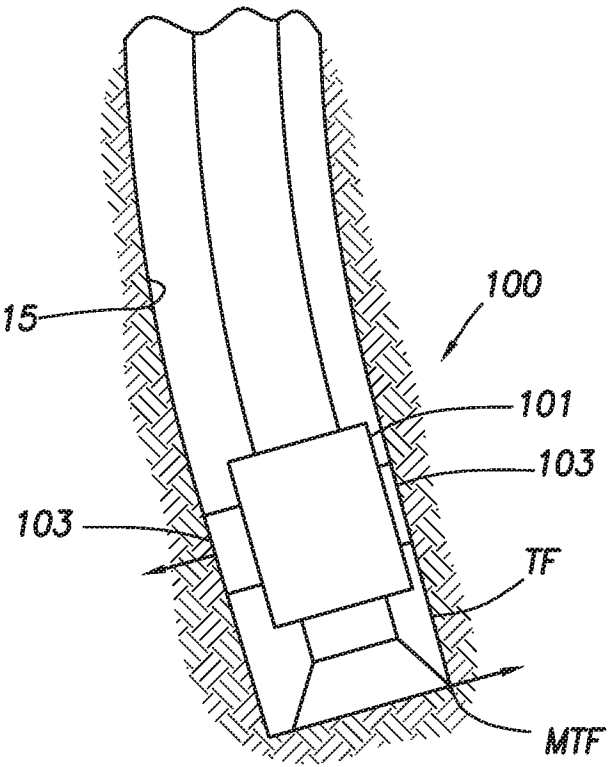
FIG. 9 depicts a cross section of a downhole steering tool consistent with at least one embodiment of the present disclosure.

To form a deviated wellbore, the initial change in direction of wellbore 15, referred to herein as a kick-off from vertical, as depicted in FIG. 9, may be defined with respect to a magnetic toolface. In some embodiments, at least one steering blade 103 may apply an eccentric force to the opposite side of the target toolface against wellbore 15.

In some embodiments, when vertical or, for example and without limitation, within 5° to 10° of vertical, a magnetic toolface may be used. Above, for example and without limitation, 5° to 10° of inclination, a gravity toolface may be utilized.

In some embodiments, in vertical kick-off, magnetic toolface (MTF) may be used to kick off to the desired direction (e.g. referenced to magnetic field, such as north, south, east, west or magnetic toolface to be zero, referencing to the magnetic north). The equation for the MTF may be given by:

$$MTF = \arctan\left(\frac{M_y}{M_x}\right)$$

Figure 10A:
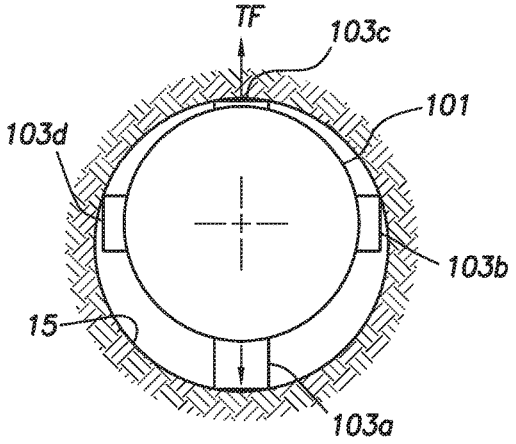
FIGS. 10A-D depict schematic cross sections of a downhole steering tool consistent with at least one embodiment of the present disclosure in various rotational positions.
Figure 10B:
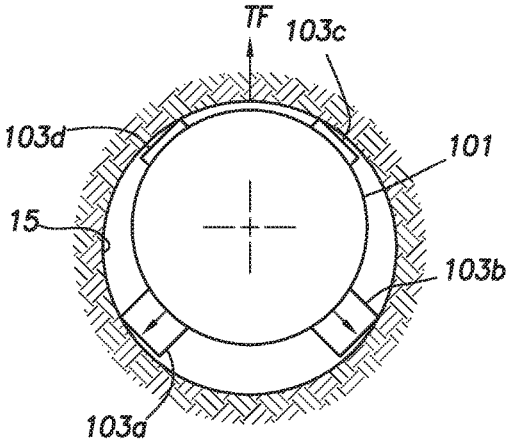
Figure 10C:
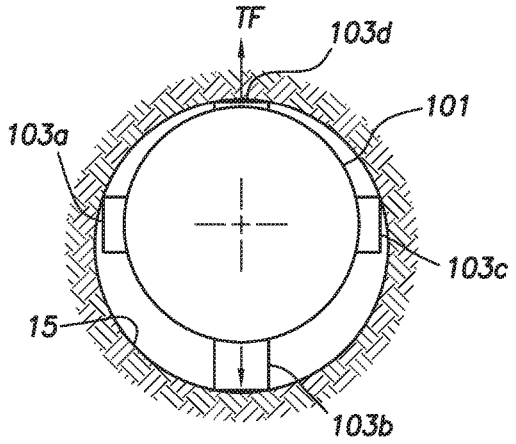
Figure 10D:
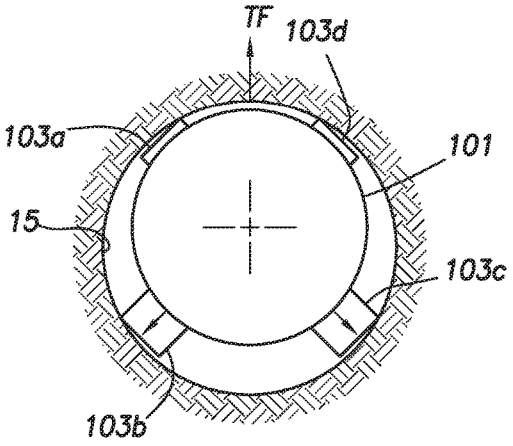

In some embodiments, as housing 101 rotates, the steering blade or blades 103 aligned substantially opposite of the target toolface changes. Controller 237 may be configured to actuate either one or two adjacent steering blades 103 to apply an eccentric steering force on wellbore 15 to push downhole steering tool 100 in a desired direction corresponding with the target toolface. In some embodiments, the steering blades 103 not actuated by controller 237 may be extended to provide gripping pressure as they are in the partially open position. For example and without limitation, as depicted in FIGS. 10A-D, as housing 101 rotates substantially slowly, e.g. one revolution per hour, steering blades 103*a-d*, as they rotate relative to wellbore 15, are sequentially actuated when oriented opposite the target toolface (TF). In FIG. 10A, steering blade 103*a* is actuated. In FIG. 10B, after housing 101 rotates, steering blades 103*a* and 103*b* are actuated. In FIG. 10C, steering blade 103*b* alone is actuated, and in FIG. 10D, steering blades 103*b* and 103*c* are actuated.

In some embodiments, the target toolface (either MTF or GTF) may be downlinked to downhole steering tool 100. In some embodiments, the target toolface may be computed based on the target inclination or target inclination/azimuth downlinked to downhole steering tool 100. In some such embodiments, controller 237 may use a closed-loop control system for inclination/azimuth hold.

In some embodiments, as depicted in FIGS. 5A-D and 6A-D, adjustable orifices 109' may be controlled by ring valve 215. Ring valve 215 may be controlled by controller 237. Ring valve 215, may include manifold 217 and valve ring 231. Manifold 217 may be generally tubular in shape and may include upper manifold surface 219. Upper manifold surface 219 may be continuous or may include one or more cutouts as shown. Manifold 217 may include manifold orifice sets 221 arranged about upper manifold surface 219. In some embodiments, each manifold orifice set 221 may be fluidly coupled to a single adjustable orifice 109'. Each manifold orifice set 221 may be coupled to a corresponding steering port 107. Fluids controlled by ring valve 215 may include, but are not limited to, drilling mud, such as oil-based drilling mud or water-based drilling mud, air, mist, foam, water, oil, including gear oil, hydraulic fluid or other fluids within mandrel 12.

Figure 6A:
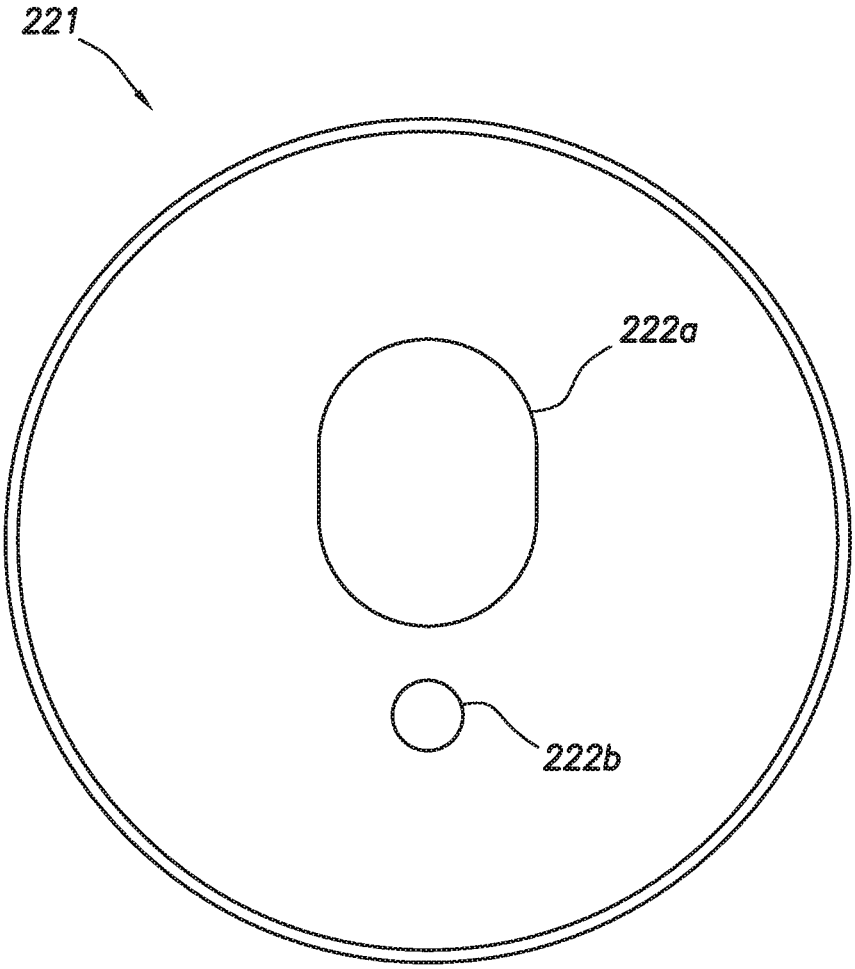
FIG. 6A depicts a detail view of a manifold orifice set of the manifold of FIG. 5D.
Figure 6B:
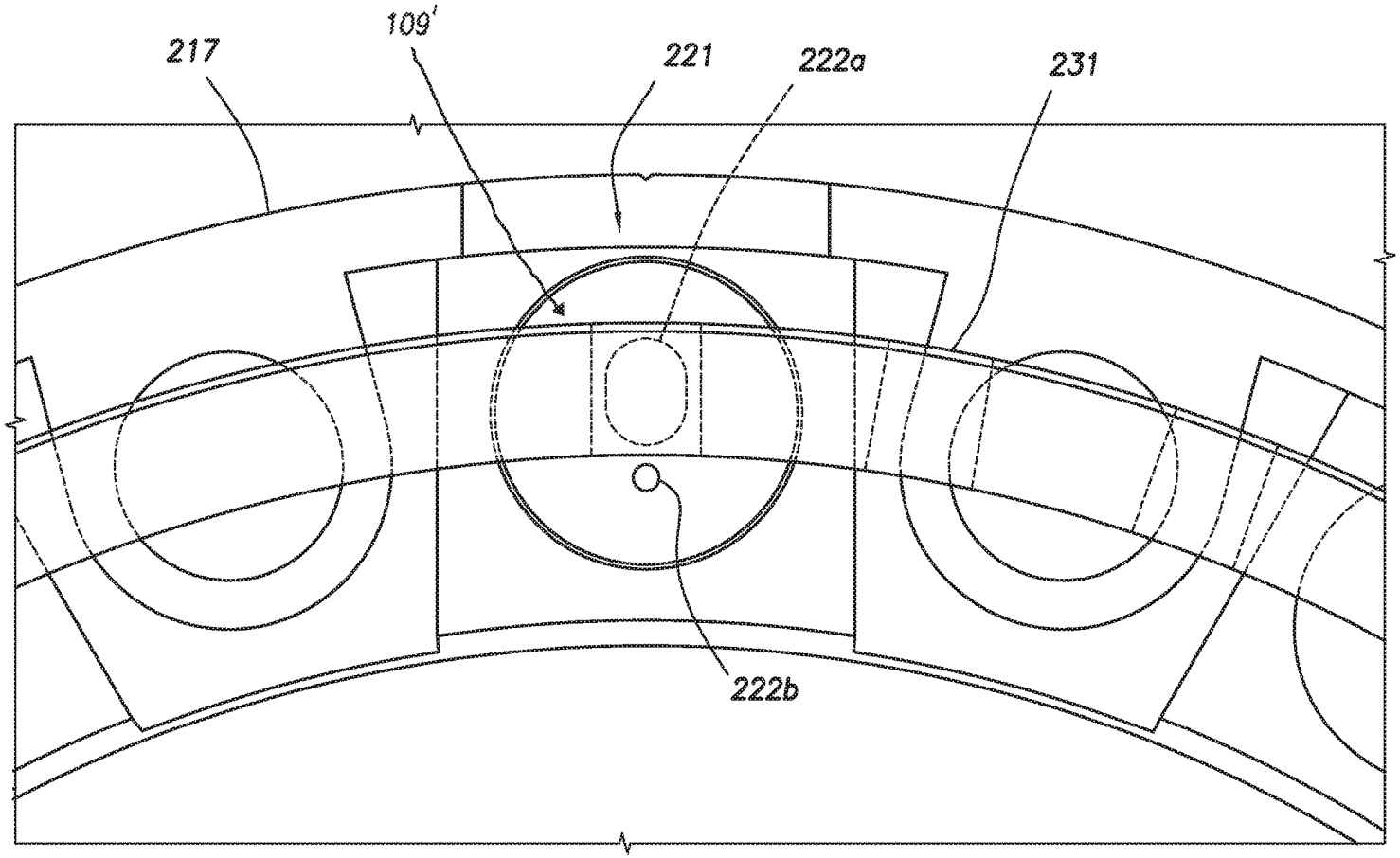
FIG. 6B-D depict partially transparent views of the manifold of FIG. 5D.
Figure 6C:
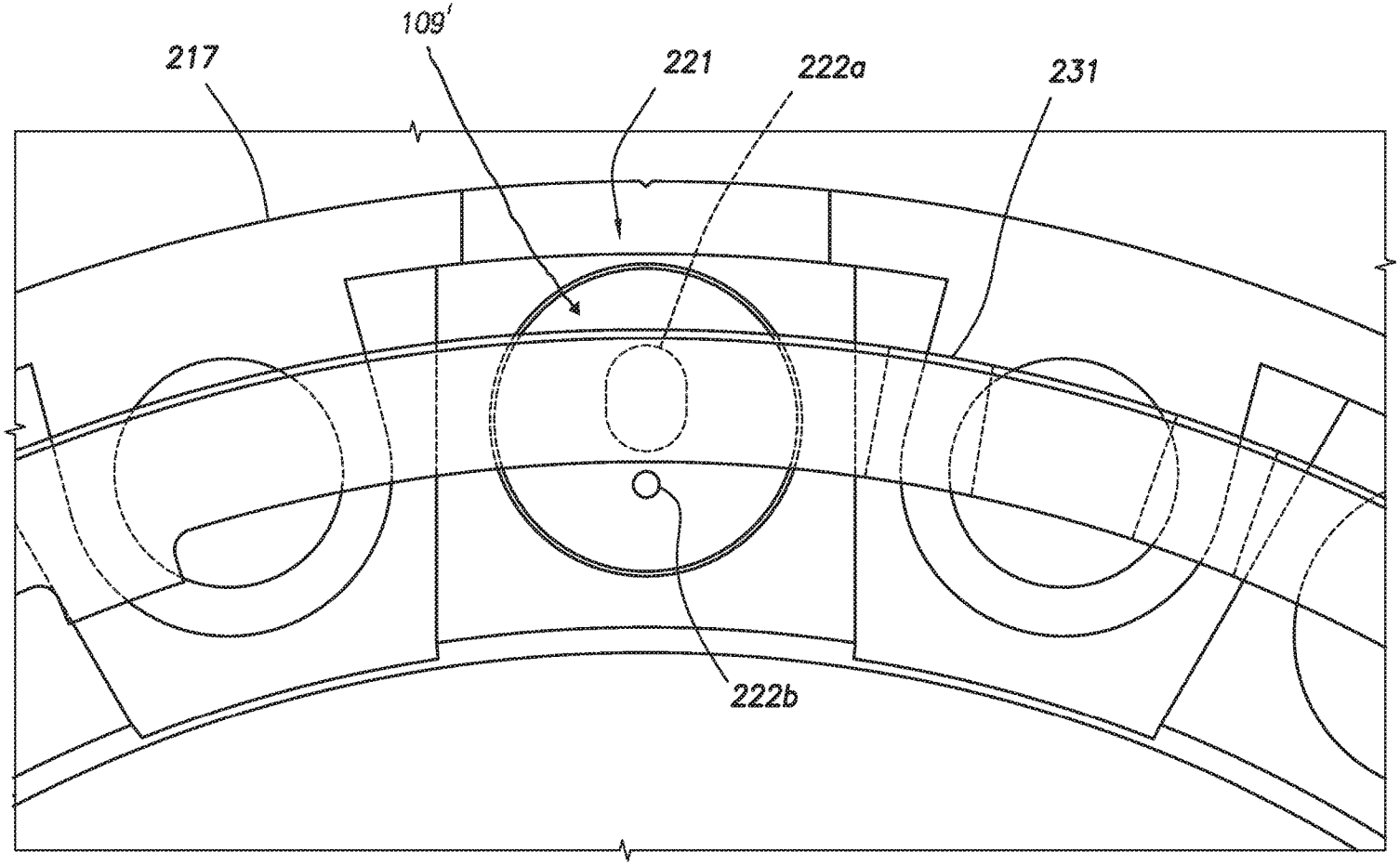
Figure 6D:
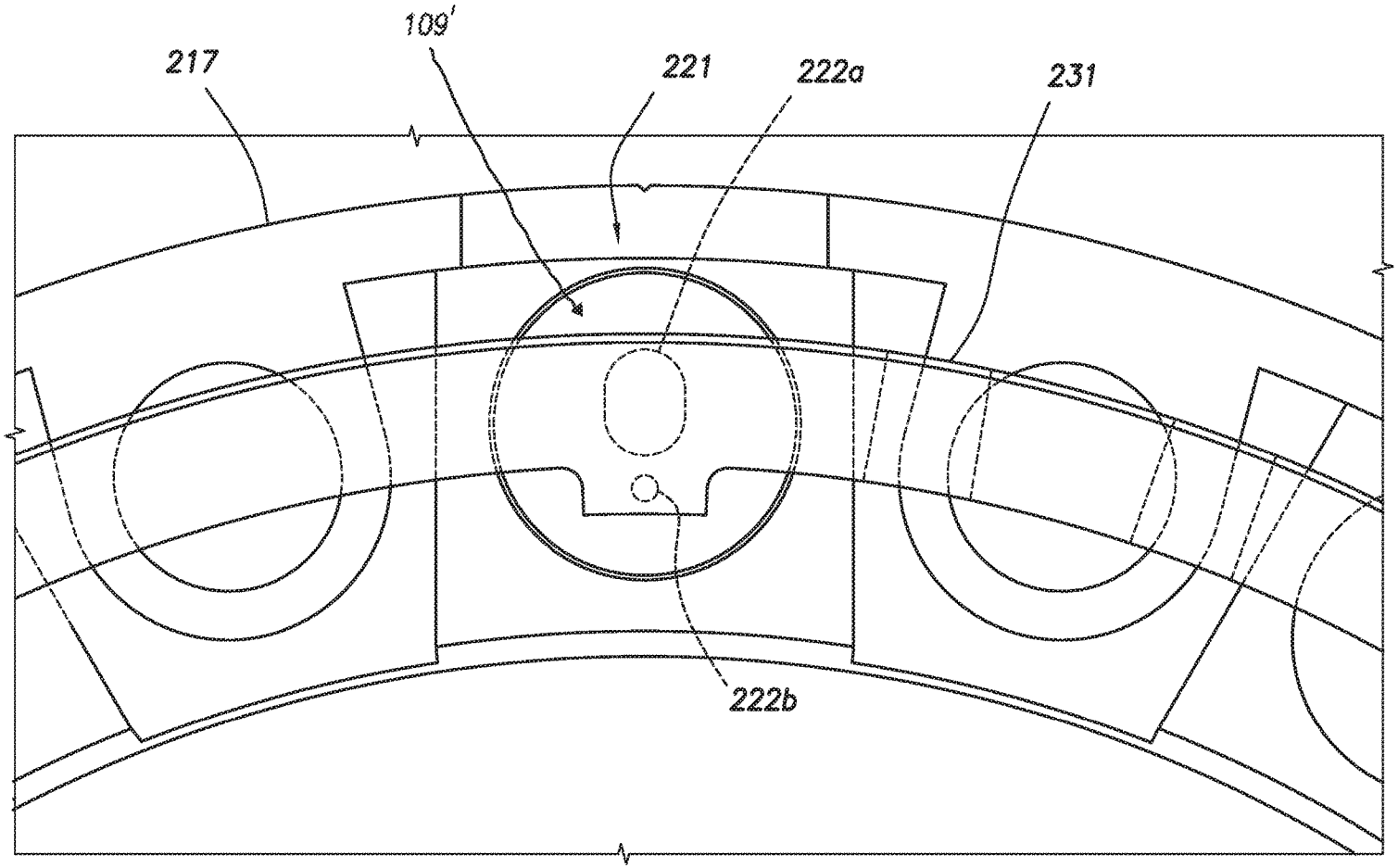

In some embodiments, as depicted in FIG. 6A-D, each manifold orifice set 221 may include two or more orifices, here depicted as steering manifold orifice 222*a* and gripping manifold orifice 222*b*. Although depicted as round, each orifice of manifold orifice set 221 may be formed in any shape including, for example and without limitation, orifices that are circular, oval shaped, elliptical, square, rectangular, rhomboidal, oblong, triangular, hexagonal, octagonal, obround, or any other shape. In some embodiments, each manifold orifice set 221 may include multiple steering manifold orifices 222*a* or multiple gripping manifold orifices 222*b*. In some embodiments, steering manifold orifice 222*a* may be larger than gripping manifold orifice 222*b*. In other embodiments, steering manifold orifice 222*a* may be smaller than or the same size as gripping manifold orifice 222*b*. In some embodiments, steering manifold orifice 222*a* or steering manifold orifice 222*a* and gripping manifold orifice 222*b* may be exposed to fluid flow by ring valve 215 when adjustable orifice 109' is in the fully open position as described above, defining a fully open manifold orifice set as depicted in FIG. 6B. In some embodiments, only gripping manifold orifice 222*b* may be exposed to fluid flow by ring valve 215 when adjustable orifice 109' is in the partially open position defining a partially open manifold orifice set as depicted in FIG. 6C. In some embodiments, both steering manifold orifice 222*a* and gripping manifold orifice 222*b* may be closed to fluid flow by ring valve 215 when adjustable orifice 109' is in the closed position as depicted in FIG. 6D.

Valve ring 231 may be generally annular. Valve ring 231 may be rotated by one or more motors 235. In some embodiments, motor 235 may be an electric motor, such as, for example and without limitation, a brushless DC (direct current) motor. In some embodiments, motor 235 may be controlled by controller 237. In some embodiments, controller 237 may include electronics configured to actuate motor 235. In some embodiments, controller 237 may include one or more sensors, such as, for example and without limitation, accelerometers, gyroscopes, magnetometers, etc., and may use information detected by the one or more sensors to control motor 235. In some embodiments, valve ring 231 may include one or more position markers 254 such as magnetic markers or magnets. Controller 237 may include one or more valve ring position sensors 256 to determine the position of valve ring 231. Valve ring position sensors 256 may include, for example and without limitation, one or more pick up coils, magnetometers, Hall-effect sensors, mechanical position sensors, or optical position sensors. In some embodiments, controller 237 may include electronics for receiving instructions for controlling motor 235. In some embodiments, controller 237 may include one or more power supplies, such as, for example and without limitation, batteries 239, for powering controller 237 and motor 235. Motor 235 may be coupled to valve ring 231 by one or more mechanical linkages such as gearbox 232 which may include, for example and without limitation, drive ring 233 and pinion 241 or other linkages. In some embodiments, valve ring 231 may be coupled to or formed as part of a rotor of motor 235.

Controller 237 may include, for example and without limitation, one or more microcontrollers, microprocessors, FPGAs (field programmable gate arrays), a combination of analog devices, such analog integrated circuits (ICs), or any other devices known in the art, which may be programmed with motor controller logic and algorithms, including angular position controller logic and algorithms.

Figure 5C:
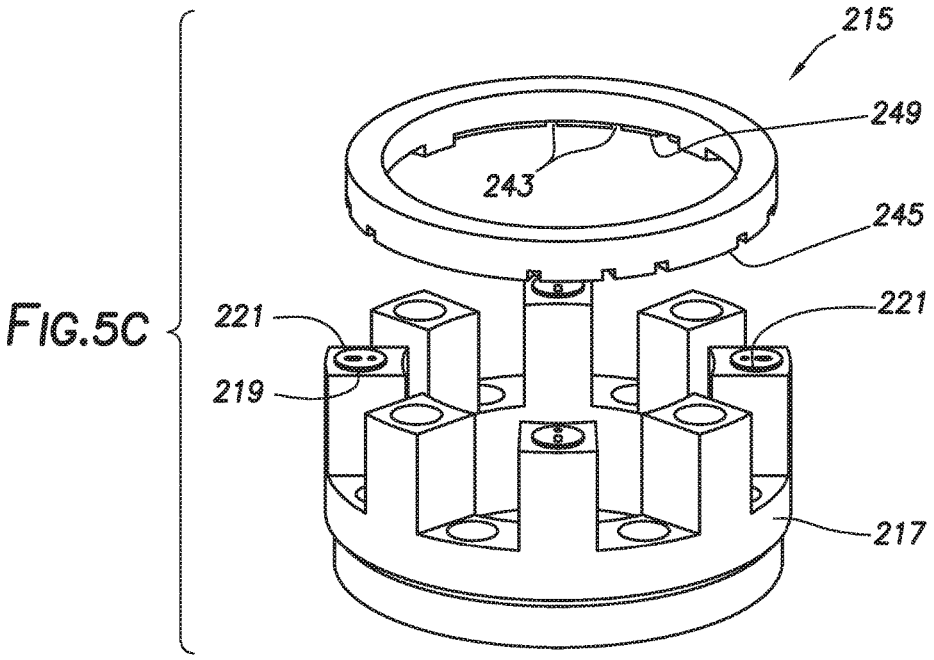
FIG. 5C depicts a perspective view of components of the downhole steering tool of FIG. 5A.
Figure 5D:
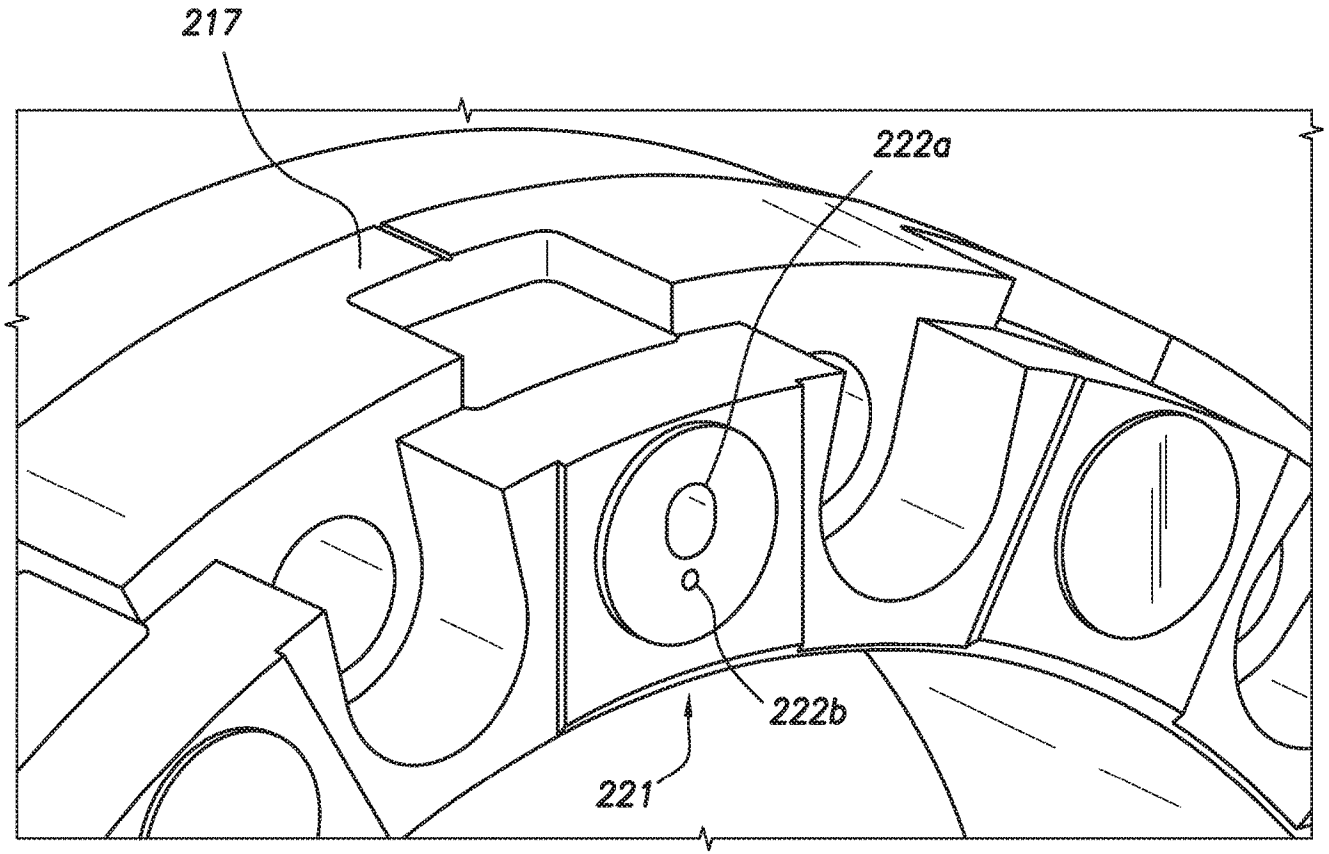
FIG. 5D depicts a perspective view of the manifold of FIG. 5A.

In some embodiments, valve ring 231 may include one or more slots 243 formed on lower ring surface 245 thereof (shown in FIG. 5C). In some embodiments, slots 243 may be radial in orientation. Lower ring surface 245 may abut or be positioned in abutment with upper manifold surface 219 such that when a slot 243 is aligned with a one or more orifices of a manifold orifice set 221 of manifold 217, fluid may flow through the aligned orifices from fluid supply port 247 coupled to the interior of mandrel 12 as previously discussed herein. Valve ring 231 may be rotated by motor 235, moving slots 243 into and out of alignment with manifold orifice sets 221. In some embodiments, valve ring 231 may be rotatable by one or more full revolutions. In some embodiments, slots 243 may be arranged such that valve ring 231 needs only rotate a partial turn to actuate each of adjustable orifices 109'. In some embodiments, slots 243 may be arranged about valve ring 231 such that adjustable orifices 109' opposite one another are not open at the same time. In some embodiments, slots 243 may be arranged such that adjacent adjustable orifices 109' may be opened at the same time.

In some embodiments, lip 249 may be formed in lower ring surface 245 of valve ring 231. Lip 249 may be positioned such that lower ring surface 245 of valve ring 231 blocks steering manifold orifice 222*a* when aligned with lip 249 and not with slot 243 while gripping manifold orifice 222*b* is exposed to fluid supply port 247, thereby partially opening the corresponding manifold orifice set 221. In some embodiments, lip 249 may be discontinuous such that all manifold orifice sets 221 may be fully closed in a certain position of valve ring 231.

For example, FIGS. 7A-J depict an exemplary valve ring 231 (in semitransparent view) positioned manifold 217. Each drawing depicts valve ring 231 rotated to a different angular position and with slots 243 opening or closing one or more of manifold orifice sets 221*a-d* as outlined in the following table.

TABLE 1

Ring Valve Positions FIGS. 7A-7J

| FIG. # | Valve Ring Angular Position | Orifice Set 1 (221a) | Orifice Set 2 (221b) | Orifice Set 3 (221c) | Orifice Set 4 (221d) |
|---|---|---|---|---|---|
| 7A | 0° | OPEN | PARTIALLY OPEN | PARTIALLY OPEN | PARTIALLY OPEN |
| 7B | 5°* | PARTIALLY OPEN | PARTIALLY OPEN | PARTIALLY OPEN | PARTIALLY OPEN |
| 7C | 10° | OPEN | OPEN | PARTIALLY OPEN | PARTIALLY OPEN |
| 7D | 20° | PARTIALLY OPEN | OPEN | PARTIALLY OPEN | PARTIALLY OPEN |
| 7E | 30° | PARTIALLY OPEN | OPEN | OPEN | PARTIALLY OPEN |
| 7F | 40° | PARTIALLY OPEN | PARTIALLY OPEN | OPEN | PARTIALLY OPEN |
| 7G | 50° | PARTIALLY OPEN | PARTIALLY OPEN | OPEN | OPEN |
| 7H | 60° | PARTIALLY OPEN | PARTIALLY OPEN | PARTIALLY OPEN | OPEN |
| 7I | 70° | OPEN | PARTIALLY OPEN | PARTIALLY OPEN | OPEN |
| 7J | 80° | CLOSED | CLOSED | CLOSED | CLOSED |

Figure 7A:
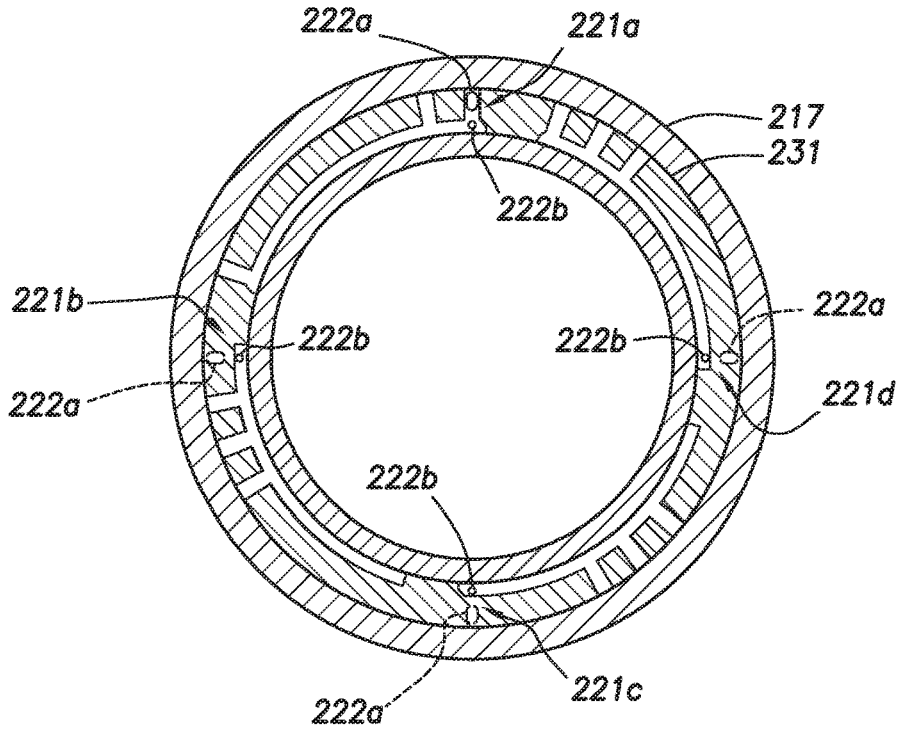
FIGS. 7A-7J depict a semitransparent view of a ring valve consistent with at least one embodiment of the present disclosure in various positions.
Figure 7B:
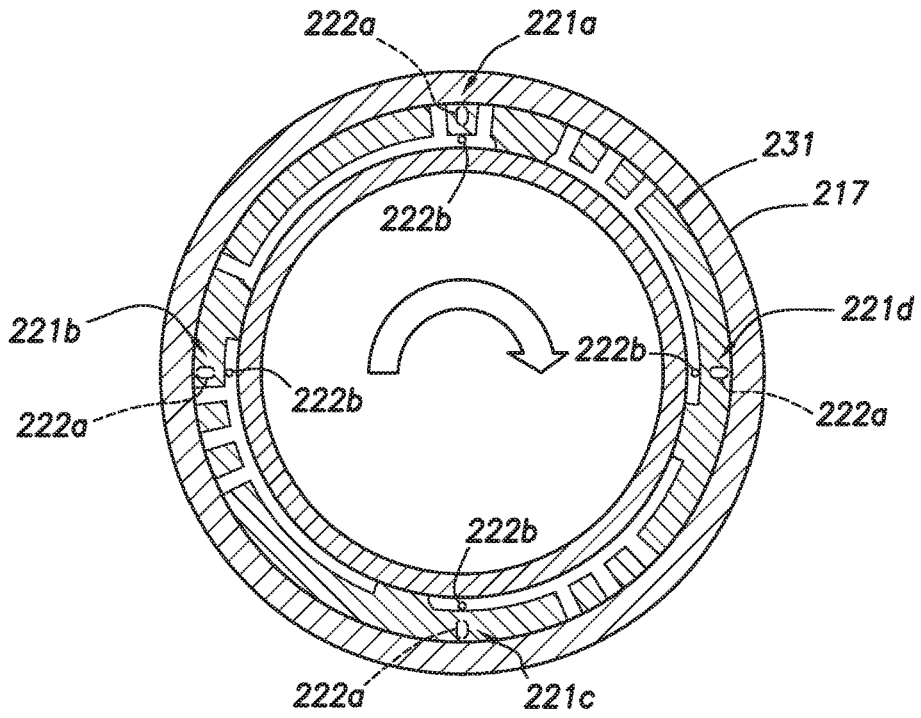
Figure 7C:
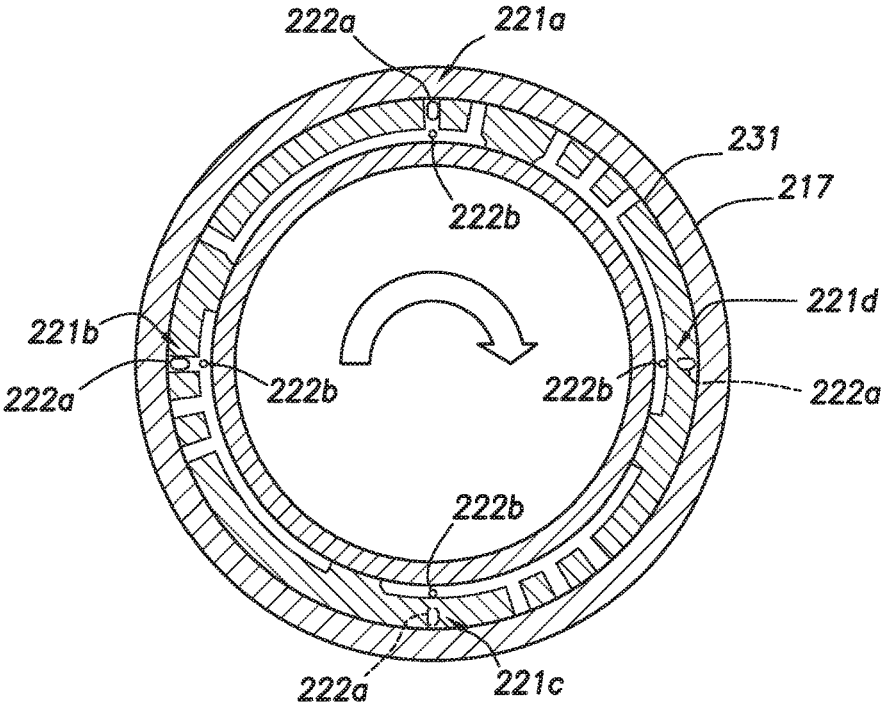
Figure 7D:
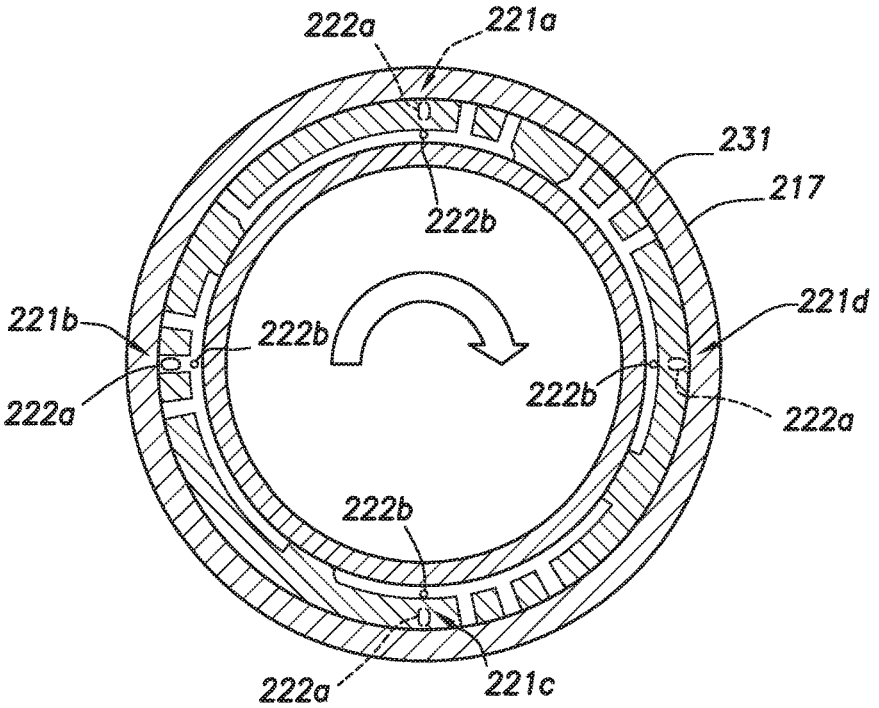
Figure 7E:
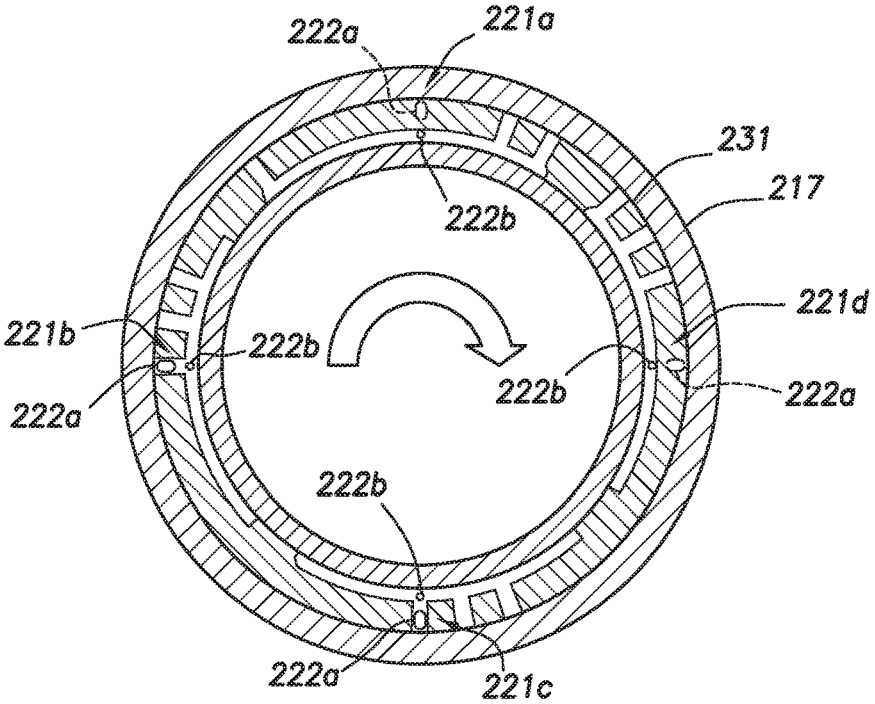
Figure 7F:
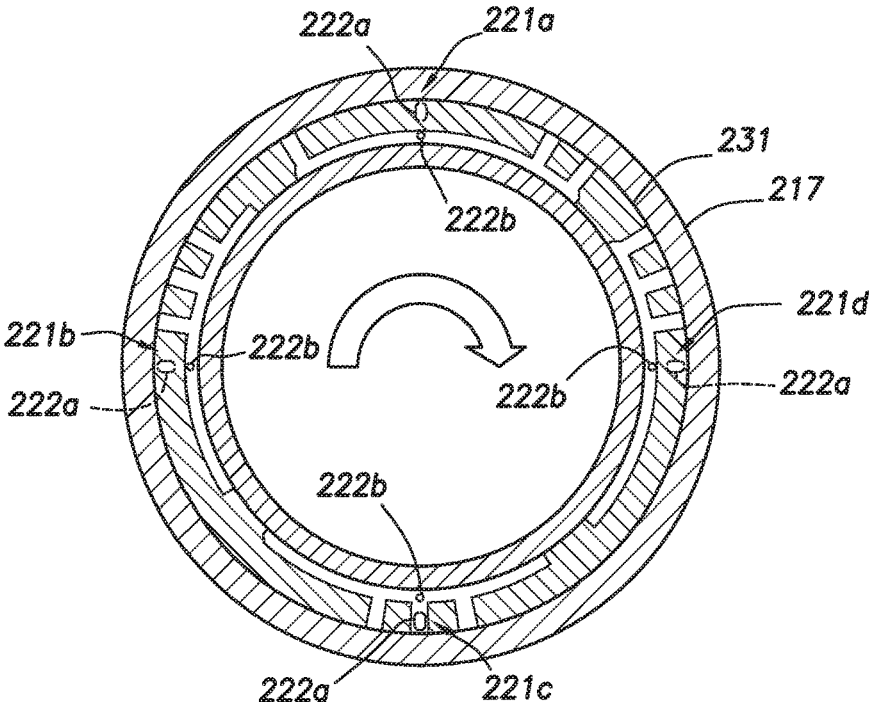
Figure 7G:
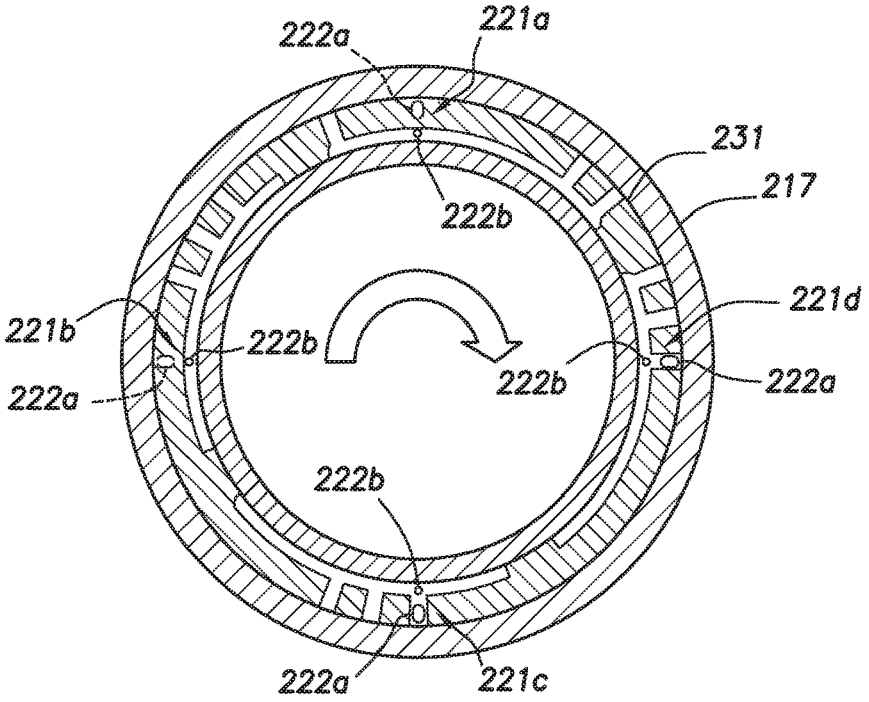
Figure 7H:
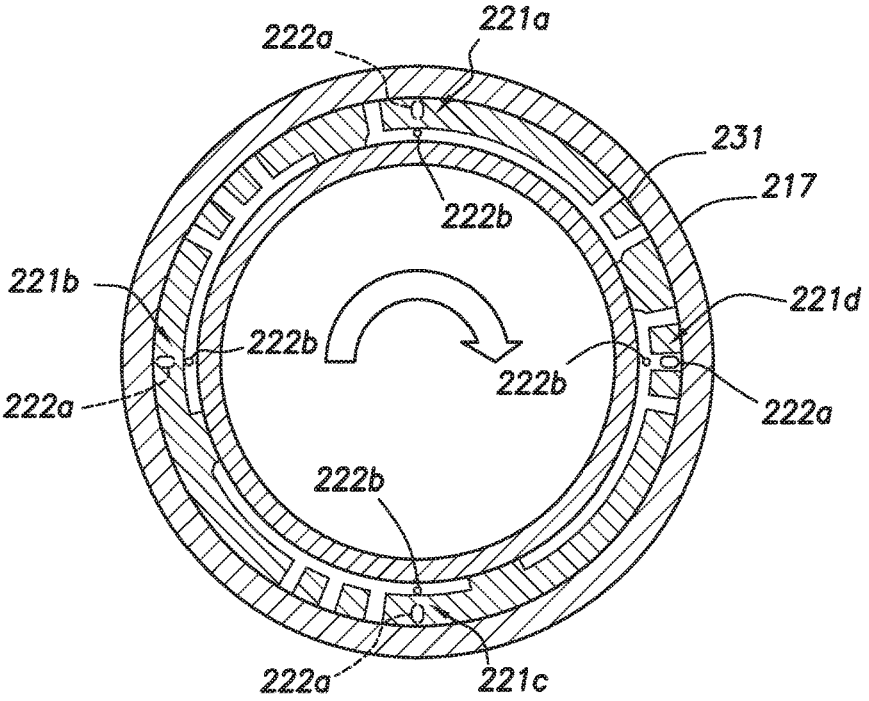
Figure 7I:
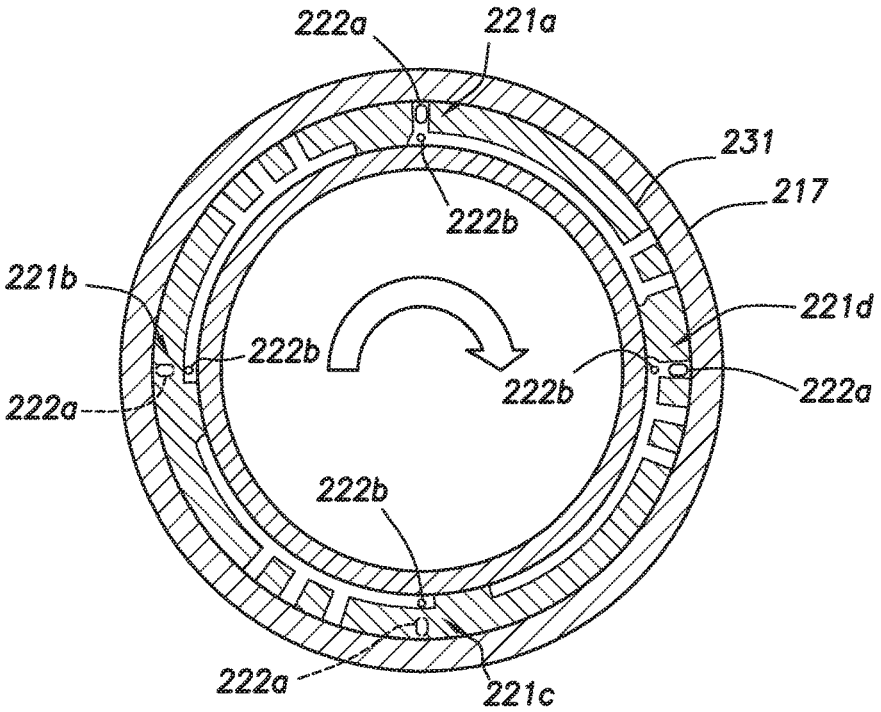
Figure 7J:
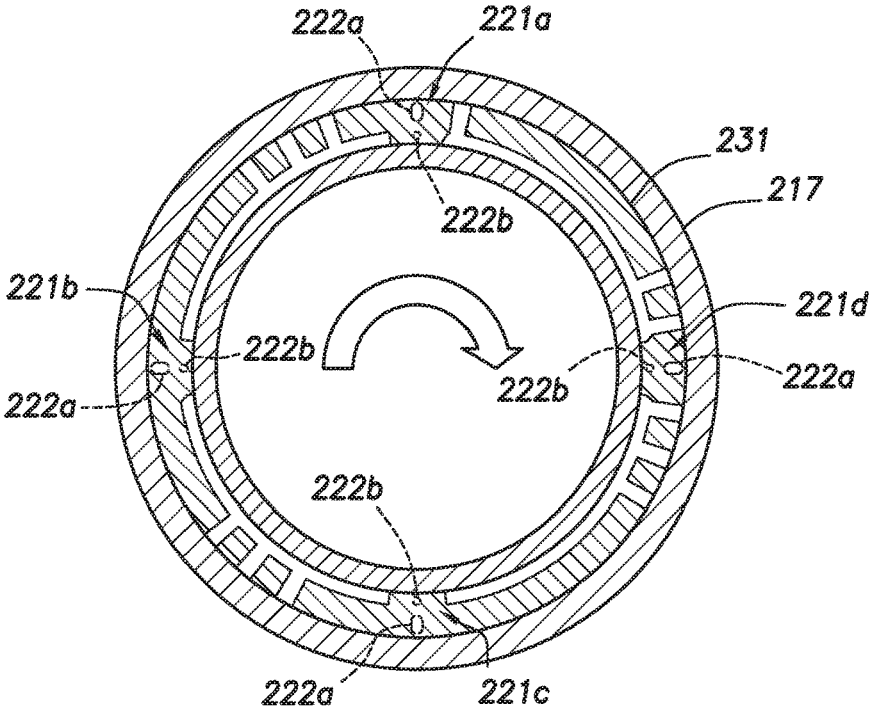

In some embodiments, although described as at a 5° offset of valve ring 231, the position shown in FIG. 7B in which each manifold orifice set 221*a-d* is partially closed may be between any of the other positions, such as at 15°, 25°, etc. In some embodiments, though not depicted, a position of valve ring 231 may include slots 243 such that in a position, all manifold orifice sets 221*a-d* are open. The position shown in FIG. 7B (all manifold orifice sets 221*a-d* being partially open) may be used to create a substantially neutral steering tendency of downhole steering tool 100 by exerting the same amount of force on each steering blade 103, and in some embodiments, this valve position is used to drill a substantially straight borehole, including and but not limited to long tangent sections and horizontal sections, with some drop tendency compensation and course correction. Additionally, in some embodiments, the extension of each steering blade 103 by the same amount of force may cause all steering blades 103 to contact wellbore 15 and grip thereagainst, thereby, for example and without limitation, reducing rotation of slowly rotating housing 101.

Figure 11:
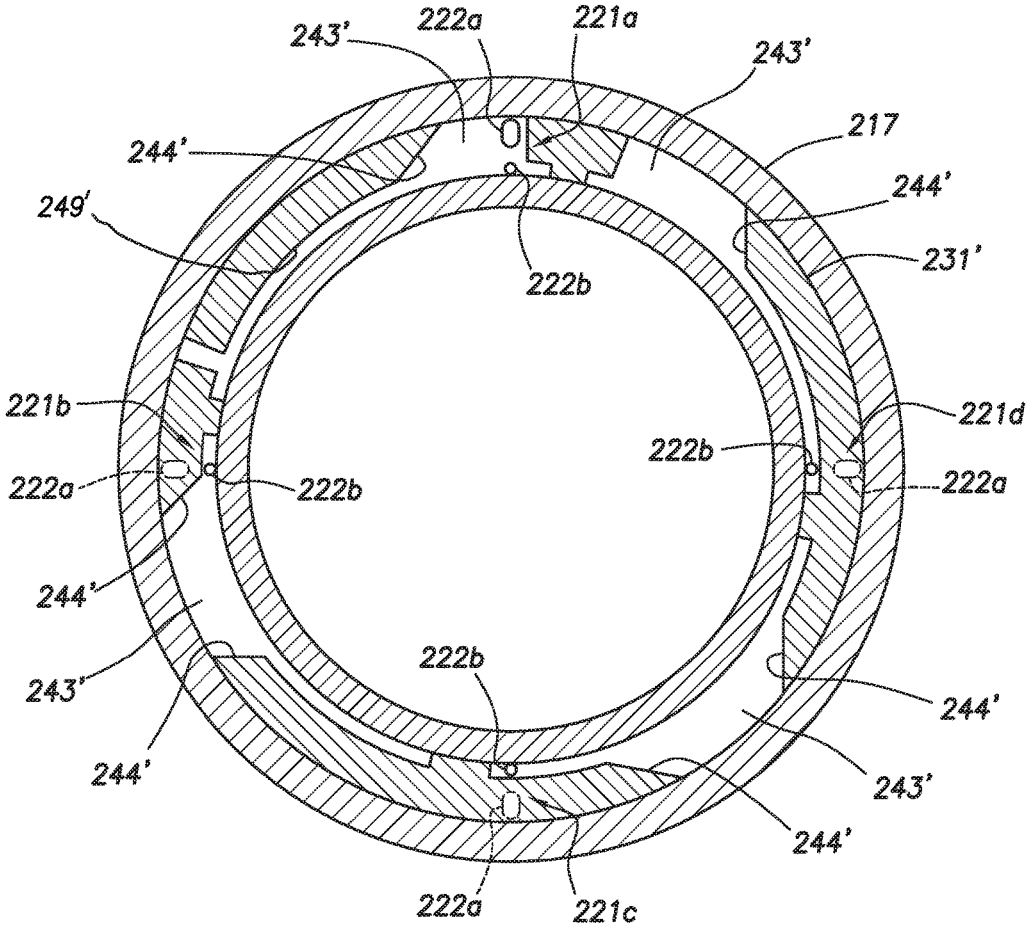
FIG. 11 depicts a semitransparent view of a ring valve consistent with at least one embodiment of the present disclosure.

In some embodiments, the rotation of valve ring 231' between a position in which one or more manifold orifice sets 221*a-d* are open to a position in which one or more manifold orifice sets 221*a-d* are closed may require a large amount of torque on motor 235. This increase in torque required may, for example and without limitation, require a higher peak current and therefore larger amount of power to be supplied to motor 235. This increase in torque required due to the increasing pressure drop across manifold orifice sets 221*a-d* as they are closed may, for example and without limitation, cause valve ring 231' to get stuck, jam, or otherwise not be able to close the respective manifold orifice set 221*a-d*. In some embodiments, as depicted in FIG. 11, valve ring 231' may include one or more slots 243' which may include taper 244'. In some embodiments, taper 244' may be formed in lip 249'. In some embodiments, as valve ring 231' is rotated, tapers 244' may allow for gradual opening or closing of manifold orifice sets 221*a-d*, thereby reducing the likelihood of valve ring 231' to get stuck, jam, or otherwise not be able to close the respective manifold orifice set 221*a-d* as valve ring 231' is moved between positions and reducing peak current or power supplied to the motor 235.

In some embodiments, valve ring 231" as depicted in FIG. 13 may be rotated to different angular positions (labeled A-J) such that slots 243" open, partially open, or close one or more of manifold orifice sets 221*a-d* as outlined in Table 2 below:

TABLE 2

Ring Valve Positions FIG. 13

| Position | Valve Ring Angular Position | Orifice Set 1 (221a) | Orifice Set 2 (221b) | Orifice Set 3 (221c) | Orifice Set 4 (221d) |
|---|---|---|---|---|---|
| A | 0° | OPEN | PARTIALLY OPEN | PARTIALLY OPEN | PARTIALLY OPEN |
| B | 9° | OPEN | OPEN | PARTIALLY OPEN | PARTIALLY OPEN |
| C | 18° | PARTIALLY OPEN | OPEN | PARTIALLY OPEN | PARTIALLY OPEN |
| D | 27° | PARTIALLY OPEN | OPEN | OPEN | PARTIALLY OPEN |
| E | 36° | PARTIALLY OPEN | PARTIALLY OPEN | OPEN | PARTIALLY OPEN |
| F | 45° | PARTIALLY OPEN | PARTIALLY OPEN | OPEN | OPEN |
| G | 54° | PARTIALLY OPEN | PARTIALLY OPEN | PARTIALLY OPEN | OPEN |
| H | 63° | OPEN | PARTIALLY OPEN | PARTIALLY OPEN | OPEN |
| I | 74° | CLOSED | CLOSED | CLOSED | CLOSED |
| J | 81° | OPEN | OPEN | OPEN | OPEN |

In some embodiments, valve ring 231" may include intermediate projections 246 positioned between certain adjacent positions in which rotation of valve ring 231" would not otherwise close or partially close the respective manifold orifice set 221*a-d*. For example, intermediate projection 246 may, as depicted in FIG. 13, cause partial closing of manifold orifice set 221*a* as valve ring 231" rotates between position A and position B. In such an embodiment, the arrangement of intermediate projections 246 and slots 243" may partially close all manifold orifice sets 221*a-d* at intermediate positions between one or more of positions A-J. For example, intermediate projections 246 may be positioned to partially close manifold orifice set 221*a* at intermediate positions between positions J and A and between positions A and B, partially close manifold orifice set 221*b* at intermediate positions between B and C and between positions C and D, partially close manifold orifice set 221*c* at intermediate positions between D and E and between positions E and F, and partially close manifold orifice set 221*d* at intermediate positions between F and G and between positions G and H as valve ring 231" rotates between positions, placing each respective manifold orifice set 221*a-d* in the above described partially open position. In some embodiments, with all four manifold orifice sets 221*a-d* may cause the same amount of force to be applied to each steering blade 103 as described herein above. In some embodiments, valve ring 231" may be intentionally rotated to one of the intermediate positions, defined as between positions A and B, B and C, C and D, D and E, E and F, F and G, G and H, H and I, I and J, or J and A, allowing for such a condition to be reached. In some such embodiments, the intermediate positions may be reached by a rotation of 4.5° of valve ring 231" from any of positions A-J.

Figure 12:
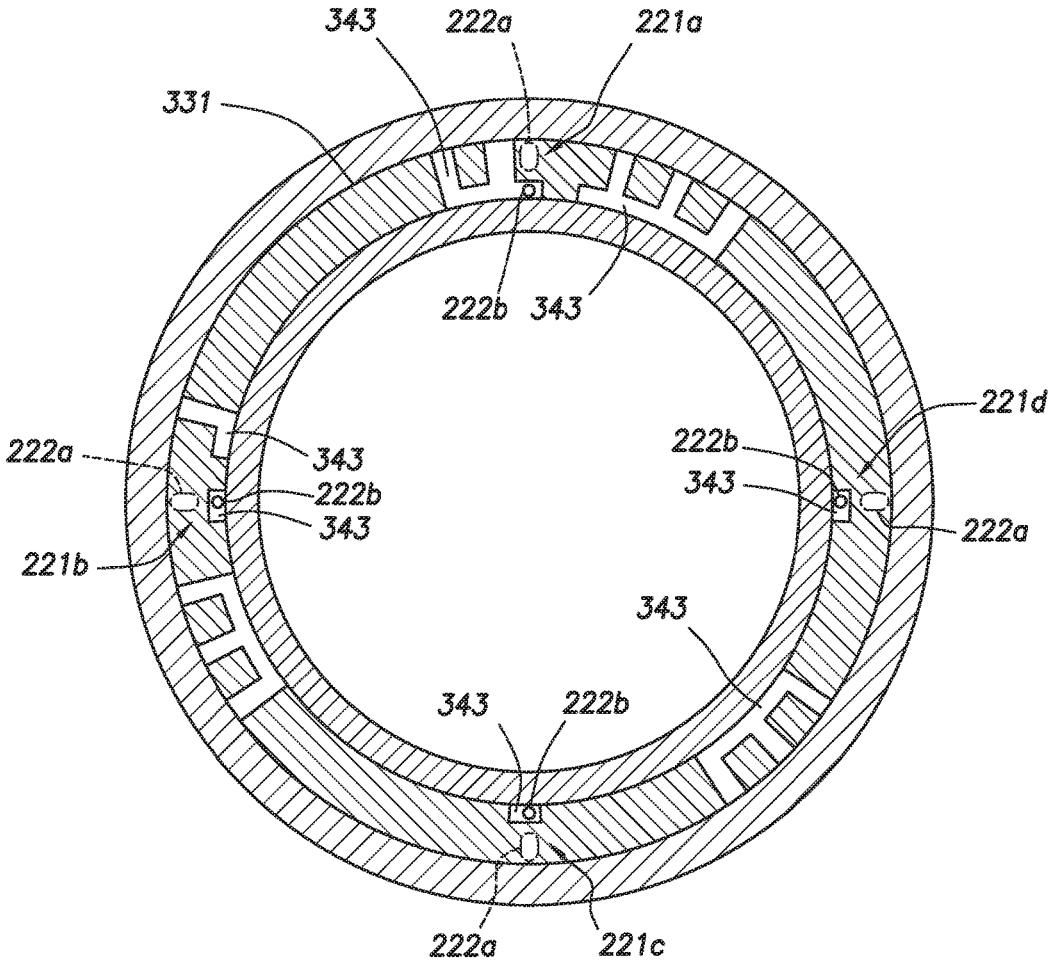
FIG. 12 depicts a semitransparent view of a ring valve consistent with at least one embodiment of the present disclosure.

In some embodiments, as depicted in FIG. 12, valve ring 331 may include slots 343 and may not include a lip such as lip 249 as described herein above. In such embodiments, slots 343 may be arranged such that depending on the rotational position of valve ring 331, each of manifold orifice sets 221*a-d* may be opened, partially opened, or closed. In some such embodiments, slots 343 may be arranged about valve ring 331 such that manifold orifice sets 221*a-d* opposite one another are not open at the same time. In some embodiments, slots 343 may be arranged such that manifold orifice sets 221*a-d* may be opened at the same time. In some embodiments, slots 343 may be arranged such that at a certain rotational position of valve ring 331, all manifold orifice sets 221*a-d* may be partially open as depicted in FIG. 12. For example, in some embodiments, positions of valve ring 331 may result in the opening and closing of manifold orifice sets 221*a-d* as outlined in Table 3.

TABLE 3

| Ring Valve Positions FIG. 12 | | | | |
|---|---|---|---|---|
| Valve Ring Angular Position | Orifice Set 1 (221a) | Orifice Set 2 (221b) | Orifice Set 3 (221c) | Orifice Set 4 (221d) |
| 0° | PARTIALLY OPEN | PARTIALLY OPEN | PARTIALLY OPEN | PARTIALLY OPEN |
| 5°* | OPEN | CLOSED | CLOSED | CLOSED |
| 15° | OPEN | OPEN | CLOSED | CLOSED |
| 25° | CLOSED | OPEN | CLOSED | CLOSED |
| 35° | CLOSED | OPEN | OPEN | CLOSED |
| 45° | CLOSED | CLOSED | OPEN | CLOSED |
| 55° | CLOSED | CLOSED | OPEN | OPEN |
| 65° | CLOSED | CLOSED | CLOSED | OPEN |
| 75° | OPEN | CLOSED | CLOSED | OPEN |
| −5° | CLOSED | CLOSED | CLOSED | CLOSED |

Although described with respect to a slowly rotating housing 101, one having ordinary skill in the art with the benefit of this disclosure will understand that rotation speed of housing 101 is not limited to the above-mentioned rotation speeds. The steering direction may be controlled with any rotation speed. Additionally, the specific arrangements described herein of slots 243, 243' of valve rings 231, 231', 331 including any tapers 244', 244" are exemplary and are not intended to limit the scope of this disclosure. Combinations of the described arrangements as well as other arrangements of slots and valve rings may be utilized without deviating from the scope of this disclosure.

The methods described herein are configured for downhole implementation via one or more controllers deployed downhole (e.g., in a vertical/directional drilling tool). A suitable controller may include, for example, a programmable processor, such as a microprocessor or a microcontroller and processor-readable or computer-readable program code embodying logic. A suitable processor may be utilized, for example, to execute the method embodiments described above with respect to FIGS. 7A-J, and 10A-D as well as the corresponding disclosed mathematical equations for gravity/magnetic toolface. A suitable controller may also optionally include other controllable components, such as sensors (e.g., a temperature sensor), data storage devices, power supplies, timers, and the like. The controller may also be disposed to be in electronic communication with the other sensors (e.g., to receive the continuous inclination and azimuth measurements). A suitable controller may also optionally communicate with other instruments in the drill string, such as, for example, telemetry systems that communicate with the surface. A suitable controller may further optionally include volatile or non-volatile memory or a data storage device.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A downhole steering tool comprising:

a housing coupled to and positioned about a tubular mandrel, the housing able to rotate about the mandrel, the housing having a steering cylinder formed therein;

a steering blade coupled to the housing, the steering blade at least partially positioned within the steering cylinder, the steering blade extendable by an extension force to contact a wellbore, the extension force caused by a differential pressure between a steering cylinder pressure and a pressure in the wellbore surrounding the downhole tool, the differential pressure caused by fluid pressure of a fluid within the steering cylinder, the steering cylinder fluidly coupled to a first steering port; and a ring valve, the ring valve including:

a manifold, the manifold being generally tubular and including an upper manifold surface, the manifold including at least one manifold orifice set, each manifold orifice set including two or more manifold orifices, the at least one manifold orifice set including a first manifold orifice set, the first manifold orifice set extending between the upper manifold surface and the first steering port, the first manifold orifice set fluidly coupled to the first steering port, the two or more manifold orifices of the first manifold orifice set including a steering manifold orifice and a gripping manifold orifice, the manifold orifice set defining an adjustable orifice, the adjustable orifice fluidly coupled between an interior of the mandrel and the steering cylinder, the adjustable orifice adjustable between an open position and at least one of a partially open position and a closed position; and a valve ring, the valve ring being annular, the valve ring having a lower ring surface positioned in abutment with the upper manifold surface, the valve ring having a radial slot formed in the lower ring surface, the valve ring rotatable relative to the manifold.

2. The downhole steering tool of claim 1, wherein the valve ring is positioned in a first valve ring angular position and the slot is aligned with the manifold orifice set.

3. The downhole steering tool of claim 2, further comprising:

a second steering blade positioned on the housing, the second steering blade extendable by an extension force to contact a wellbore, the extension force caused by a second differential pressure between a second steering cylinder and the pressure in the surrounding wellbore, the differential pressure caused by fluid pressure of a fluid within the second steering cylinder, the second steering cylinder within the housing, the second steering blade at least partially positioned within the second steering cylinder, the second steering cylinder fluidly coupled to a second steering port; and wherein the at least one manifold orifice set includes a second manifold orifice set fluidly coupled to the second steering port; and wherein the valve ring further comprises a second slot formed in the lower ring surface.

4. The downhole steering tool of claim 3, wherein the valve ring is positioned in a second valve ring angular position and the second slot is aligned with the second manifold orifice set.

5. The downhole steering tool of claim 4, wherein the ring valve is positioned in a third valve ring angular position and the slot is not aligned with the manifold orifice set.

6. The downhole steering tool of claim 3, wherein the second slot is aligned with the second manifold orifice set when the valve ring is positioned in the first valve ring angular position.

7. The downhole steering tool of claim 2, wherein the lower ring surface further comprises a lip positioned such that the steering manifold orifice is closed, and the gripping manifold orifice is open when the slot is not aligned with the manifold orifice set.

8. The downhole steering tool of claim 7, wherein the lip is discontinuous, such that the steering manifold orifice and the gripping manifold orifice are closed when the valve ring is at a second valve ring angular position.

9. The downhole steering tool of claim 1, further comprising a valve ring position sensor.

10. The downhole steering tool of claim 9, wherein the valve ring position sensor comprises one or more pick-up coils, magnetometers, Hall-effect sensors, mechanical position sensors, or optical position sensors.

11. The downhole steering tool of claim 1, wherein the valve ring is coupled to a motor.

12. The downhole steering tool of claim 11, wherein the motor is a brushless direct current motor.

13. The downhole steering tool of claim 11, wherein the valve ring is coupled to the motor by a drive ring and pinion or by a gearbox.

14. The downhole steering tool of claim 1, wherein the slot further comprises a taper.

15. The downhole steering tool of claim 1, further comprising a controller electrically coupled to the ring valve.

16. The downhole steering tool of claim 15, wherein the controller comprises one or more microcontrollers, microprocessors, FPGAs (field programmable gate arrays), or analog integrated circuits.

17. The downhole steering tool of claim 15, wherein the controller is electrically coupled to one or more sensors.

18. The downhole steering tool of claim 17, further comprising a differential rotation sensor positioned to detect the relative rotation between the housing and the mandrel.

19. The downhole steering tool of claim 18, wherein the differential sensor comprises one or more infrared sensors, ultrasonic sensors, Hall-effect sensors, fluxgate magnetometers, magneto-resistive magnetic-field sensors, micro-electro-mechanical system (MEMS) magnetometers, or pick-up coils.

20. The downhole steering tool of claim 19, further comprising a magnet coupled to the mandrel.

21. The downhole steering tool of claim 17, further comprising a housing rotation measurement sensor.

22. The downhole steering tool of claim 21, wherein the housing rotation sensor comprises one or more accelerometers, magnetometers, or gyroscopic sensors.

23. The downhole steering tool of claim 1, wherein the fluid is drilling mud, air, mist, foam, water, oil, or hydraulic fluid.

24. A method comprising:

providing a downhole steering tool, the downhole steering tool including a housing coupled to and positioned about a tubular mandrel, the housing able to rotate about the mandrel;

a steering cylinder, the steering cylinder formed in the housing, the steering cylinder fluidly coupled to a steering port;

a steering blade coupled to the housing, the steering blade at least partially positioned within the steering cylinder, the steering blade extendable by an extension force to contact a wellbore, the steering cylinder positioned to exert an extension force on the steering blade; and a ring valve, the ring valve including:

a manifold, the manifold being generally tubular and including an upper manifold surface, the manifold including at least one manifold orifice set, each manifold orifice set including two or more manifold orifices, the at least one manifold orifice set including a first manifold orifice set, the first manifold orifice set extending between the upper manifold surface and the first steering port, the first manifold orifice set fluidly coupled to the first steering port, the two or more manifold orifices of the first manifold orifice set including a steering manifold orifice and a gripping manifold orifice, the manifold orifice set defining an adjustable orifice, the adjustable orifice fluidly coupled between an interior of the mandrel and the steering cylinder, the adjustable orifice adjustable between an open position and at least one of a partially open position and a closed position; and a valve ring, the valve ring being annular, the valve ring having a lower ring surface positioned in abutment with the upper manifold surface, the valve ring having a radial slot formed in the lower ring surface, the valve ring rotatable relative to the manifold;

positioning the downhole steering tool in a wellbore;

supplying the fluid to the interior of the mandrel, the fluid at a pressure higher than the pressure in the surrounding wellbore;

partially opening the adjustable orifice;

flowing the fluid into the steering cylinder through the adjustable orifice, the fluid within the steering cylinder generating a differential pressure between a steering cylinder pressure and a pressure in the wellbore surrounding the downhole steering tool, the differential pressure generating a first extension force on the first steering blade;

extending the first steering blade with the first extension force;

opening the adjustable orifice; and extending the first steering blade with a second extension force, the second extension force being higher than the first extension force.

25. The method of claim 24, wherein the downhole steering tool further comprises:

a second steering blade coupled to the housing, the second steering blade extendable by an extension force to contact a wellbore, the extension force caused by a second differential pressure between a second steering cylinder and the pressure in the wellbore surrounding the downhole steering tool, the second differential pressure caused by fluid pressure of a fluid within the second steering cylinder, the second steering cylinder within the housing, the second steering blade at least partially positioned within the second steering cylinder, the second steering cylinder fluidly coupled to a second steering port; and wherein the at least one manifold orifice set includes a second manifold orifice set fluidly coupled to the second steering port defining a second adjustable orifice;

wherein the method further comprises:

partially opening the second adjustable orifice;

extending the second steering blade with a first extension force;

opening the second adjustable orifice; and extending the second steering blade with a second extension force, the second extension force being higher than the first extension force.

26. The method of claim 25, further comprising:

partially opening the first adjustable orifice while the second adjustable orifice is open;

extending the first steering blade with a first extension force; and extending the second steering blade with a second extension force, the second extension force being higher than the first extension force.

27. The method of claim 24, further comprising closing the first adjustable orifice by rotating the ring valve to a position such that the slot is not aligned with the manifold orifice set.

28. The method of claim 24, wherein the valve ring further comprises a lip formed in the lower ring surface, and the method further comprises:

partially opening the first adjustable orifice by rotating the ring valve to a position such that the slot is not aligned with the manifold orifice and the lip is aligned with the manifold orifice such that the steering manifold orifice is closed, and the gripping manifold orifice is open; and extending the first steering blade with a first extension force, the first extension force being lower than the second extension force.

* * * * *